United States Patent [19]

Ito

[11] Patent Number: 5,040,019

[45] Date of Patent: Aug. 13, 1991

[54] COPYING APPARATUS HAVING AUTOMATIC DOCUMENT FEEDER & SORTER

[75] Inventor: Masazumi Ito, Osaka, Japan

[73] Assignee: Minolta Camera Kabushiki Kaisha, Osaka, Japan

[21] Appl. No.: 284,684

[22] Filed: Dec. 15, 1988

[30] Foreign Application Priority Data

| | | | |
|---|---|---|---|
| Dec. 18, 1987 | [JP] | Japan | 62-321924 |
| Mar. 8, 1988 | [JP] | Japan | 63-54130 |
| Apr. 15, 1988 | [JP] | Japan | 63-93630 |

[51] Int. Cl.[5] ..... G03B 27/48

[52] U.S. Cl. ..... 355/50; 355/40; 355/51; 355/314

[58] Field of Search ..... 355/40, 314, 50, 51

[56] References Cited

U.S. PATENT DOCUMENTS

| | | | |
|---|---|---|---|
| 3,687,540 | 8/1972 | Hashimoto | |
| 4,099,860 | 7/1978 | Connin | 355/314 |
| 4,273,439 | 6/1981 | Markham et al. | 355/14 |
| 4,370,052 | 1/1983 | Murakami et al. | 355/14 |
| 4,411,515 | 10/1983 | Kukucka et al. | 355/14 |
| 4,437,660 | 3/1984 | Tompkins et al. | 271/290 |
| 4,442,505 | 4/1984 | Takano | 364/900 |
| 4,523,752 | 6/1985 | Kigawa et al. | 355/314 |
| 4,561,765 | 12/1985 | Masuda | 355/14 |
| 4,568,177 | 2/1986 | Sato et al. | 355/40 |
| 4,569,582 | 2/1986 | Hyltoft | 355/3 |
| 4,647,188 | 3/1987 | Komiya et al. | 355/55 |

FOREIGN PATENT DOCUMENTS

| | | |
|---|---|---|
| 55-50260 | 4/1980 | Japan |
| 59-77457 | 5/1984 | Japan |
| 59-200270 | 11/1984 | Japan |
| 62-126081 | 6/1987 | Japan |

*Primary Examiner*—Monroe H. Hayes

*Attorney, Agent, or Firm*—Burns, Doane, Swecker & Mathis

[57] ABSTRACT

A copying apparatus comprising, an automatic document feeder (ADF) having a plurality of document feed units and a sorter for sorting copies to perform multijobs, in which the jobs held in respective document feed units are set in order of priority such that the urgent job is processed preferentially, and the desired job completion time is set so as to control the job to be completed till then even for the job having an inferior priority, thereby waste of waiting time can be saved remarkably at copying, and in the sorter, the job having an inferior priority is contained adjacent the final bin which is not used frequently corresponding to the necessary number of bins to facilitate smooth utilization of the sorter.

28 Claims, 41 Drawing Sheets

Fig. 9

| PARAMETER / DOCUMENT FEED UNIT NUMBER | DOCUMENT EXISTS | COPY BEING DONE | SEQUENCE NUMBER | NUMBER OF COPIES | DISCHARGE UNIT NUMBER | JOB MODE | NUMBER OF DOCUMENT SHEETS | SORTER MODE |
|---|---|---|---|---|---|---|---|---|
| 1 | 1 | 1 | 2 | 10 | 4 | 0 | 1 | 3 |
| 2 | 1 | 0 | 3 | 3 | 1 | 2 | 3 | 1 |
| 3 | 0 | 0 | 1 | 5 | 5 | 0 | 5 | 2 |
| --- | --- | --- | --- | --- | --- | --- | --- | --- |
| n | — | — | — | — | — | — | — | — |

COPYING APPARATUS HAVING AUTOMATIC DOCUMENT FEEDER & SORTER

BACKGROUND OF THE INVENTION

1. Field of the Invention

The present invention relates to a copying apparatus having an automatic document feeder (hereinafter referred to as ADF) which feeds documents automatically to a document table, and a sorter which includes a plurality of bins and automatically sorts copied paper, more particularly, it relates to improvement of a multijob function.

2. Description of Related Art

In a copying apparatus having an ADF, various apparatus having a so-called multijob functions have been developed to save time required for the users to wait for their turn, for example, by automatically processing copying operations successively for document groups of respective plural users set on a plurality of document feed trays.

For example, in Japanese Patent Application Laid-Open No. 59-200270, a multijob copying machine in which the documents are set on the document feed trays and are copied in reserved order of data for copying is disclosed.

Now, in the copying machine having such a multijob function, since processings are performed in reserved order or set order of the document independently of the users' urgent requirement, for example, when processing which is not in haste and not requiring copying immediately is reserved before those requiring a relatively urgent action, it is very inefficient as the former has to be processed first.

SUMMARY OF THE INVENTION

The present invention has been devised to solve aforesaid problems, therefore, it is a first object of the present invention to provide a copying apparatus in which multijobs are processed efficiently by giving priority to other jobs concerning to the job which is not in haste among jobs to be processed by a plurality of document feed units.

It is a second object of the present invention to provide a copying apparatus having a multijob function which is capable of completing copying by the time designated in advance by calculating the copying completion time even when the job is not in haste.

It is a third object of the present invention to provide a copying apparatus in which the necessary number of bins of a sorter is obtained on the basis of the number of documents and paper to be copied and processing mode of the sorter, and the job having an inferior urgency is contained adjacent the final bin which is not used frequently to facilitate the job having a high urgency to be removed for smooth utilization of the sorter.

The above and further objects and features of the invention will more fully be apparent from the following detailed description with accompanying drawings.

BRIEF DESCRIPTION OF THE DRAWINGS

FIG. 9 is an explanatory view of a RAM map of a RAM incorporated in a CPU.

DESCRIPTION OF THE PREFERRED EMBODIMENTS

Figure 1:
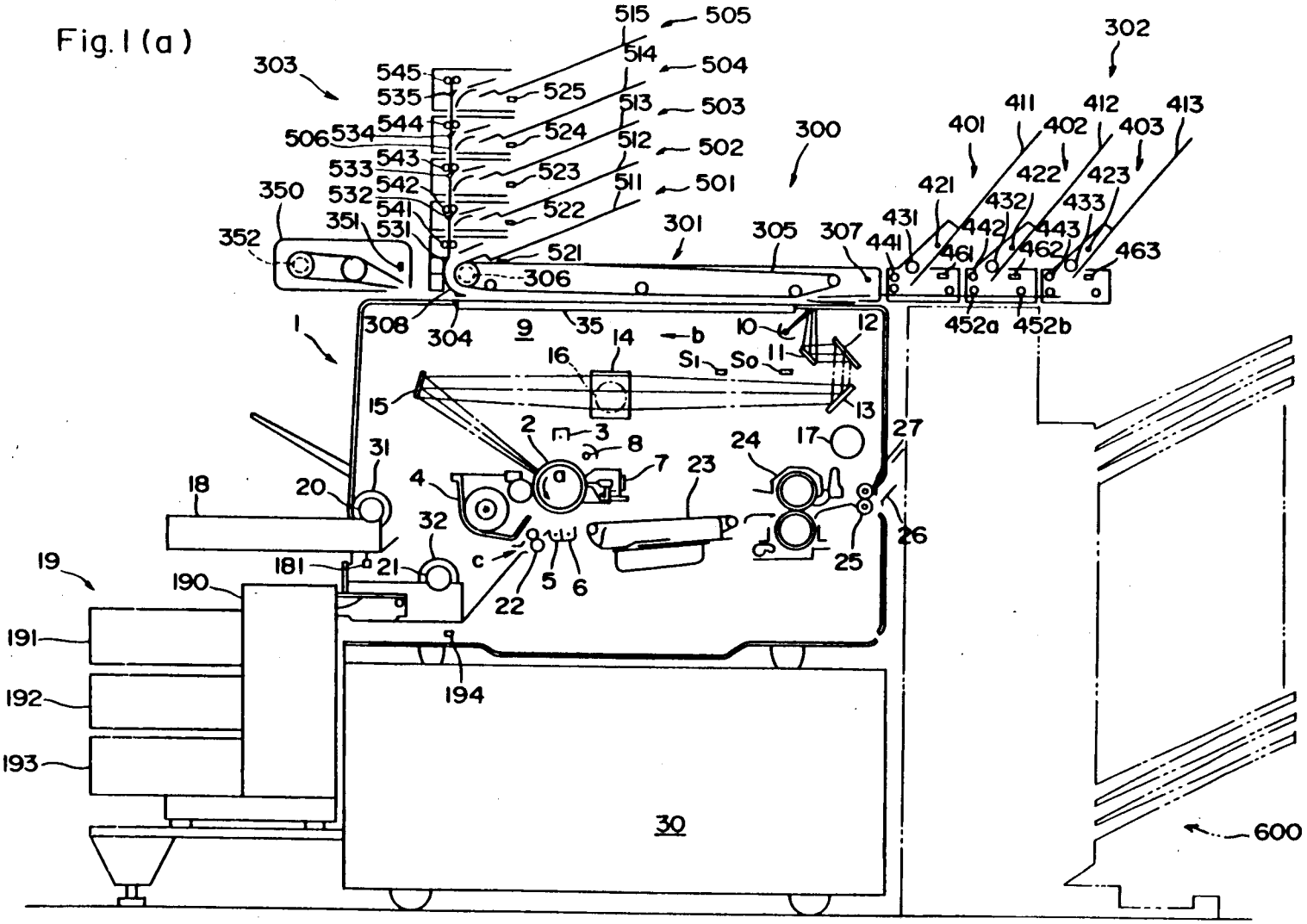
FIGS. 1*a*, 1*b* are a major portion broken and front view showing the construction of a copying machine according to the present invention.
Figure 1:
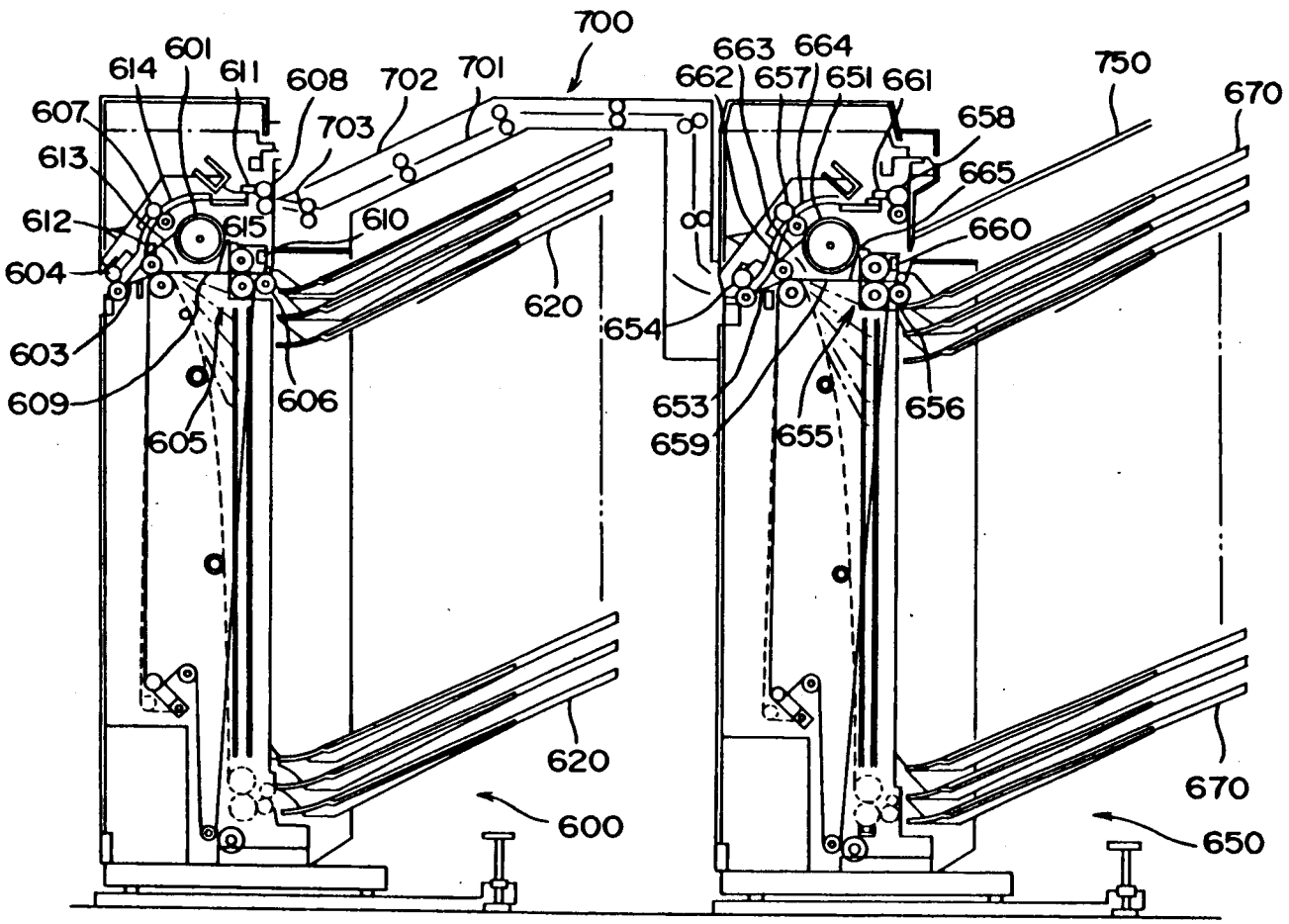

In the following, the present invention will be specifically described with reference to the drawings showing the embodiments. FIGS. 1*a*, 1*b* are a major portion broken and front view showing the construction of a copying apparatus. A main body 1 of the copying apparatus is mounted on a desk 30, and on the upper portion of the main body 1 of the present apparatus, an ADF 300 is mounted and a first and second sorters 600, 650 are mounted respectively on its right side portion.

In the figure, reference numeral 2 denotes a photosensitive drum having a light conductive layer on its peripheral surface which is rotatable in a direction of an arrow a. Above the photosensitive drum 2, there is disposed a charger 3 which applies an electric charge having a constant potential to the surface of the photosensitive drum 2. Above the photosensitive drum 2 and the charger 3 and under a document table 35, an image exposing device 9 is disposed. The image exposing device 9 comprises an exposure lamp 10, movable mirrors 11, 12, 13, a lens 14 and a reflection mirror 15 etc. A first slider consisting of the exposure lamp 10 and movable mirror 11, and a second slider consisting of the movable mirrors 12, 13 are moved in a direction of an arrow b by a slider driving motor 17.

Moving speeds of the first and second sliders are respectively (V/n) and (V/2n) (n being a copying magnification) in relation to a peripheral speed V of the photosensitive drum 2 (which is constant irrespective of equal or variable magnification). When the magnification is changed, a lens moving motor 16 is operated, and in FIG. 1, the lens 14 showing the position of equal magnification is moved respectively in the inverse direction of the arrow b or aparting from the photosensitive drum 2 at the time of enlarge-processing, and in the direction of the arrow b or approaching the photosensitive drum 2 at the time of reduce-processing. These movements of each portion of the image exposing device 9 are detected by sensors $S_0$, $S_1$.

A developing device 4 is provided at the position in the rotating direction of the photosensitive drum 2, against the charger 3. The developing device 4 develops an electrostatic latent image formed on the photosensitive drum 2 into a toner image. Under the photosensitive drum 2 or at the position in the rotating direction of the photosensitive drum 2, against the developing device 4, there is provided a transfer charger 5. The transfer charger 5 transfers the toner image, formed on the photosensitive drum 2 by the developing device 4, onto the paper to be copied (not shown) transported in a direction of an arrow c. Next to the transfer charger 5, a separation charger 6 is disposed. The separation charger 6 separates the copied paper from the photosensitive drum 2 immediately after the transfer.

A cleaning device 7 is installed posterior to the separation charger 6. The cleaning device 7 removes a toner remained on the photosensitive drum 2. Between the cleaning device 7 and the charger 3, there is provided an eraser lamp 8. The eraser lamp 8 removes by irradiating light the electric charge remained on the photosensitive drum 2.

Numerals 18, 19 respectively indicate an upper cassette and three-stage paper feed unit for containing paper to be copied, which are respectively detachable with respect to upper and lower paper inlets of a main body of the present apparatus 1. At the upper paper inlet, a paper feed roller 20 for sending out the paper to be copied and size detecting switches 181 for detecting the size of paper placed in the upper cassette 18 are provided. In the three-stage paper feed unit 19, a paper feed roller (not shown) and cassettes 191, 192 and 193 having size detecting switches (not shown) are mounted respectively on a common transport portion 190. Paper is fed from the upper portion of the transport portion 190 to the paper inlet under the upper cassette 18 of the main body 1. At the lower paper inlet, a paper feed roller 21 and size detecting switches 194 are disposed in the same way as the upper paper inlet. A paper feed cassette similar to the upper cassette can also be mounted to the lower paper inlet in place of the three-stage paper feed unit 19. At this time, the paper to be copied contained in the paper feed cassette is sent out by the paper feed roller 21 and its size is detected by the size detecting switches 194.

The paper feed rollers 20, 21 are coupled respectively to motors 31, 32 so as to be rotated. The paper to be copied sent out from the cassette is sent between the photosensitive drum 2 and the transfer charger 5 by the timing roller pair 22 in synchronism with the rotational timing of the toner image of the photosensitive drum 2 as shown by the arrow c.

The copied paper with the toner transferred image is now introduced into a fixing device 24 by means of a transport belt 23. The fixing device 24 fuses and fixes the toner image thermally onto the copied paper. The copied paper onto which the image is fixed is introduced into a sorter 601 from a paper outlet 26 of the main body 1 through a roller pair 25. A sensor 27 for detecting discharge of the copied paper from the main body 1 is disposed on the paper outlet 26.

First and second sorters 600, 650 have the same construction, and the former is connected to the main body 1 while the latter is connected to the former by means of a bridge 700. The first sorter 600 (or second sorter 650) comprises a plurality of bins 620 (or 670) arranged vertically in parallel for sorting and containing the copied paper in a sorting mode or grouping mode, and in respective bins 620 sensors (not shown) are disposed for detecting existence of the copied paper fed out. On the feeding portion of the copied paper, a roller pair 604 (or 654) and a sensor 612 (or 662) for detecting the copied paper fed into the sorter are disposed. Immediately after the roller pair 604, a selection claw 603 (or 653) for switching transport of the copied paper to a non-sorting passage 614 (or 664) or to a sorting passage 615 (or 665) is disposed. The sorting passage 615 (or 665) is constituted by an endless transport belt 609 (or 659) for transporting the copied paper to a paper discharge unit 605 (or 655) and a retractable tape 613 (or 663), and the copied paper transported through the sorting passage 615 (or 665) is detected by a sensor 610 (or 660). The paper discharge unit 605 (or 655) includes a paper discharge roller pair 606 (or 656) for discharging the copied paper to the bins 620 (or 670), and constructed to move up and down intermittently throughout the disposed width of the bins 620 (or 670) by a bin moving motor not shown.

The non-sorting passage 614 (or 664) is so constructed as to discharge the copied paper to the bridge 700 (or a non-sorting tray 750). In the passage 614 (or 664), a relay roller pair 607 (or 657), paper discharge roller pair 608 (or 658) and sensor 611 (or 661) for detecting the transport of copied paper are disposed for this purpose. The roller pairs are rotated by a sorter motor 601 (or 651).

The bridge 700 includes a transport passage 701 therein, and further provided with a selection claw 703 for switching transport of the copied paper discharged from the paper discharge roller pair 608 to the transport passage 701 or to a paper discharge portion 702 constructed on the tilted portion of the bridge 700, at a position facing the paper discharge roller pair 608 of the first sorter.

The transport passage 701 of the bridge 700 is formed by a plurality of roller pairs and guide plates, whose end portion, namely, the paper outlet of the bridge 700, is connected to the paper inlet of the second sorter 650. The paper discharge tray 750 is provided at the paper outlet of the second sorter 650 where a paper discharge roller pair 658 is disposed.

That is, by using the first and second sorters 600, 650 in connection as aforementioned, when either the sorting mode or the grouping mode is set, the copied paper is transported through the sorting passage 615, distributed to respective bins 620 from the paper discharge unit 605, and when all the bins 620 of the first sorter 600 are filled and still the bin is required, the copied paper is transported to the non-sorting passage 614, sent to the second sorter 650 by the bridge 700 and contained in the bins 670.

Now, the ADF 300 comprises a document transport control portion 301 for moving and stopping a document on the document table 35, a document feed portion 302 for feeding a document to the document transport control portion 301, a document reversing unit 350 for reversing and setting again a document, whose upper side is copied, on the original table 35 and a document discharge portion 303 for receiving the document sent from the transport control portion 301.

The document transport control portion 301 transports a document by means of a rotation belt 305 driven by a motor 306. A sensor 307 is provided on the inlet side of a document so as to detect feeding of the document. A sensor 308 is installed on the outlet side so as to detect discharging of the document.

The document feed portion 302 comprises document feed units (hereinafter referred to as DFU) 401, 402 and 403 which are detachable from one another. The DFU 401 is coupled to the document transport control portion 301, the DFU 402 to the DFU 401 and the DFU 403 to the DFU 402. The DFU 402 comprises a document tray 412 capable of placing thereon a plurality of document sheets, a delivery roller 432 for delivering the documents one by one therefrom, document transport rollers 452*a*, 452*b* and an operation panel 462. The other DFUs 401, 403 also comprise exactly the same elements. The delivery roller 432 and the rollers 452*a*, 452*b* are operated by a motor 442 provided in the unit. A sensor 422 detects the presence and absence of the document on the document tray 42.

Figure 2:
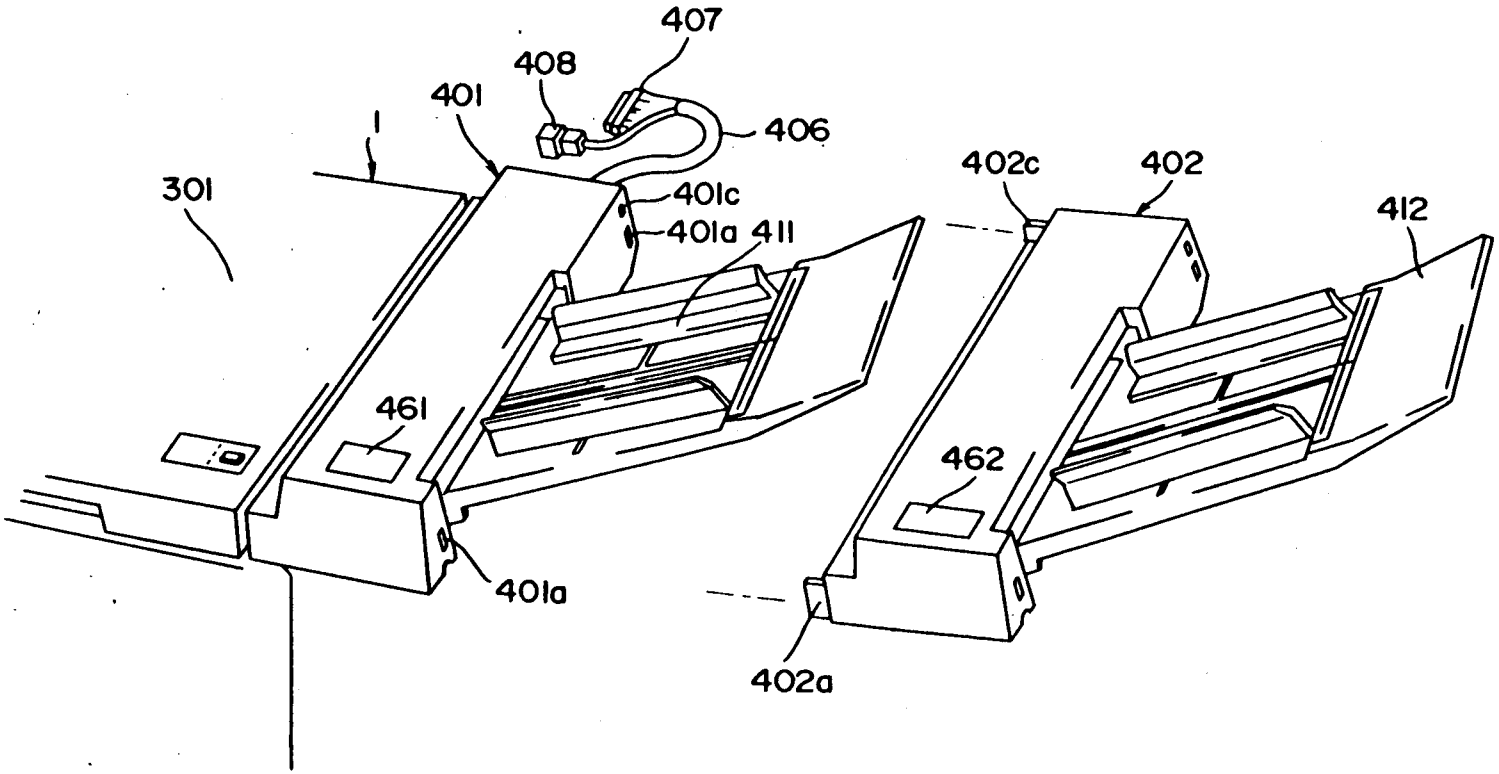
FIGS. 2 and 3 are partial external perspective views thereof.

FIG. 2 shows a specific example of the DFU. As can be seen from the DFU 402, coupling portions for coupling units each other are provided in front and the rear of the casing. At the front end of the casing, there are provided coupling claws 402*a*, 402*a* projecting forward from both lateral sides so as to engage to coupling holes 401*a*, 401*a* formed at the rear end of the casing. Electrically, they are connected by connectors 402*c*, 401*c*. Connection by the connectors establishes a channel for supply of electric power and signals between the DFUs. The DFU 401 coupled to the document transport control portion 301 has also a connector 402*c* in principle, so that it can be electrically connected to the document transport control portion 301. However, in order to assure electrical connection, a cable 406 may be drawn from the DFU 401 such that a signal line connector 407 and a power supply connector 408 can be connected to the document transport control portion 301 or to the main body of the present apparatus 1 through the cable 406.

As shown in FIG. 1, the document discharge portion 303 has vertically arranged multiple-stage paper discharge trays 511 and 515 and consists of document discharge units (hereinafter referred to as DDUs) 501, 502, 503, 504 and 505 which are detachable from each other by every paper discharge tray. The DDU 501 is coupled to the document transport control portion 301, the DDU 502 to the DDU 501, the DDU 503 to the DDU 502, the DDU 504 to the DDU 503 and the DDU 505 to the DDU 504. When these DDUs 501 to 505 are coupled, a transport passage 506 for the discharged document is formed from a lower level to an upper level. The DDUs comprise selection claws 531, 532, 533, 534 and 535 respectively for switching the transport of the document to the transport passage 506 or to the respective discharge trays. The DDUs also comprise roller pairs 541, 542, 543, 544 and 545 for sending the document to the transport passage 506. Each of the selection claws 531 to 535 is operated by an electromagnetic solenoid coupled thereto. Though the roller pairs 541 to 545 are designed to operate in principal by a small-sized motor provided in each unit, they may be operated by the driving force of a motor installed externally on the document discharge portion 303 (not shown) or the motor of the document transport control portion 301. Sensors 521 to 525 disposed under respective paper discharge trays 511 to 515 detect existence of the document on respective paper discharge trays.

Figure 3:
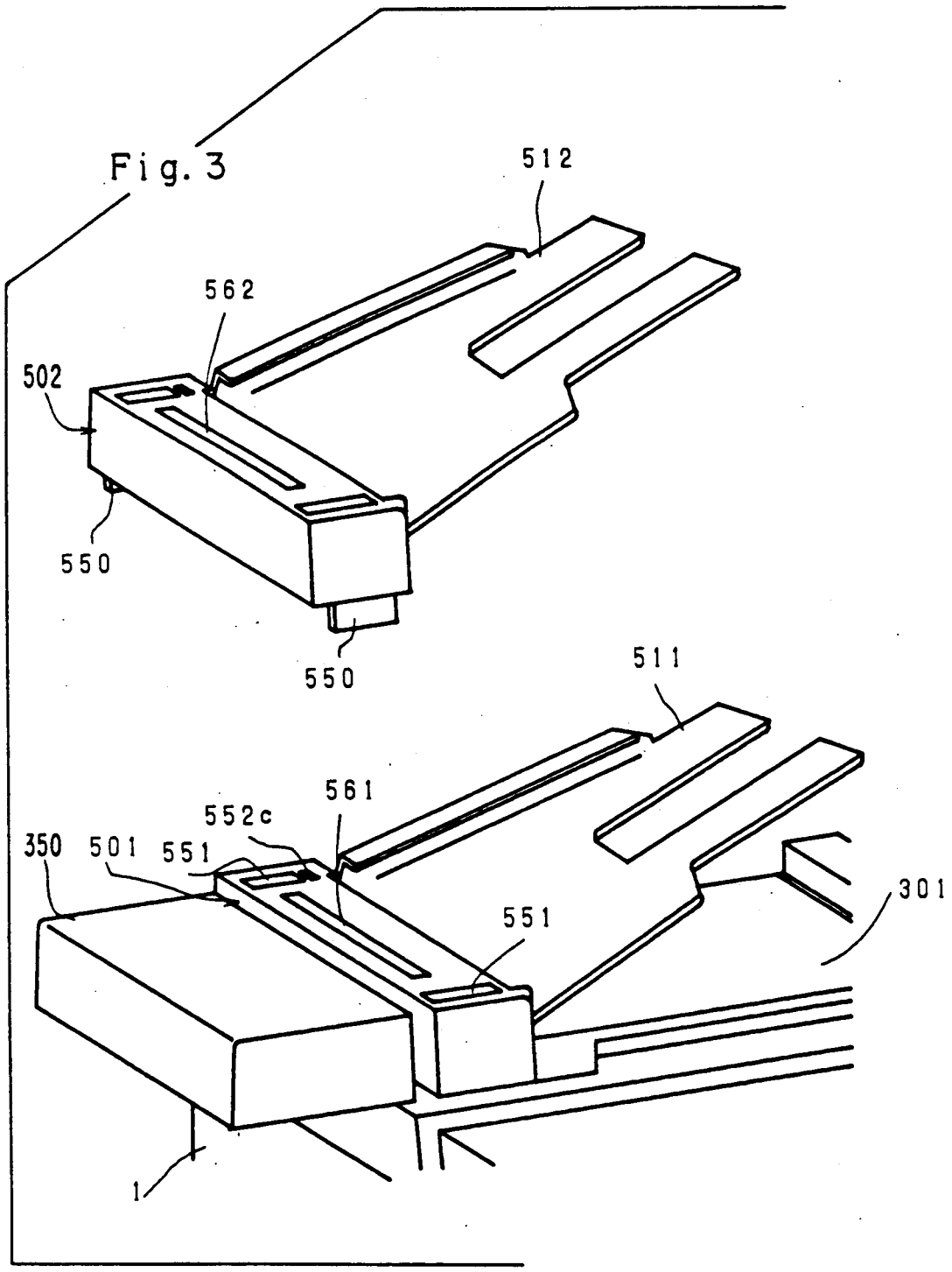

FIG. 3 shows a specific example of the DDUs. The DDUs are coupled to each other when the coupling claws 550, 550 formed on the lower surface of the casing of the DDU 502 are engaged with the coupling holes 551, 551. The DDUs are connected electrically by coupling a connector (not shown) projecting downward from the lower surface of the casing to a connector 552*c* provided on the upper portion of the casing. Elongated lateral holes 561, 562, together with elongated holes at the lower surface of the casing, serve as outlets and inlets for the document passing through the DDUs.

A document reversing unit 350 (hereinafter referred to as an R unit) is provided with a reversing motor 352 for driving the R unit 350 and a document detection sensor 351 therein. At the rear end of the document transport control portion 301, a selection claw 304 for switching the document discharged from the document table 35 to the DDUs 501 to 505 or to R unit 350 is installed.

Figure 4:
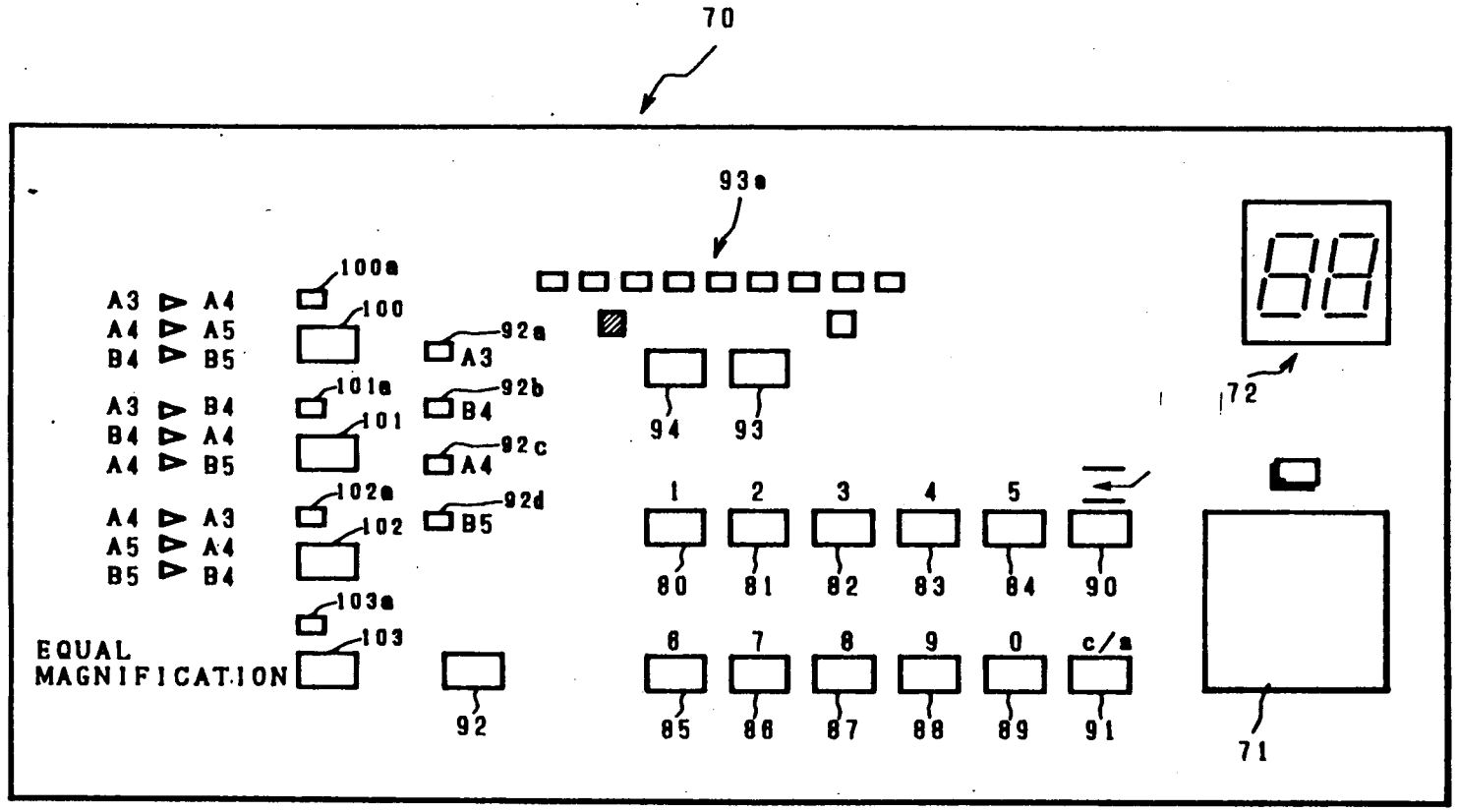
FIGS. 4 and 5 are layout views of an operation panel thereof.

FIG. 4 shows an operation panel 70 provided in front of the document table 35. Numeral 71 denotes a print key for starting copying operation and 72 is a display for displaying the number of copies. Ten keys 80 to 89 are used principally to input the number of copies. An interrupt copying key and a clear/stop key for canceling the set number and interrupting copying are indicated by 90 and 91. A paper select key 92 is a key for selecting any of paper inlets. Displays 92*a* to 92*d* display the size of sheets contained in the selected cassette. The density of an image to be copied can be set by steps by means of exposure up/down keys 93, 94. A display 93*a* shows a rate of the set image density.

Numerals 100 to 103 denote keys for selecting copying magnifications. Displays 100*a* to 102*a* display the selected magnification. On the operation panel 70, there are also provided an operation key (not shown) and so on for copying both sides of the document.

Figure 5:
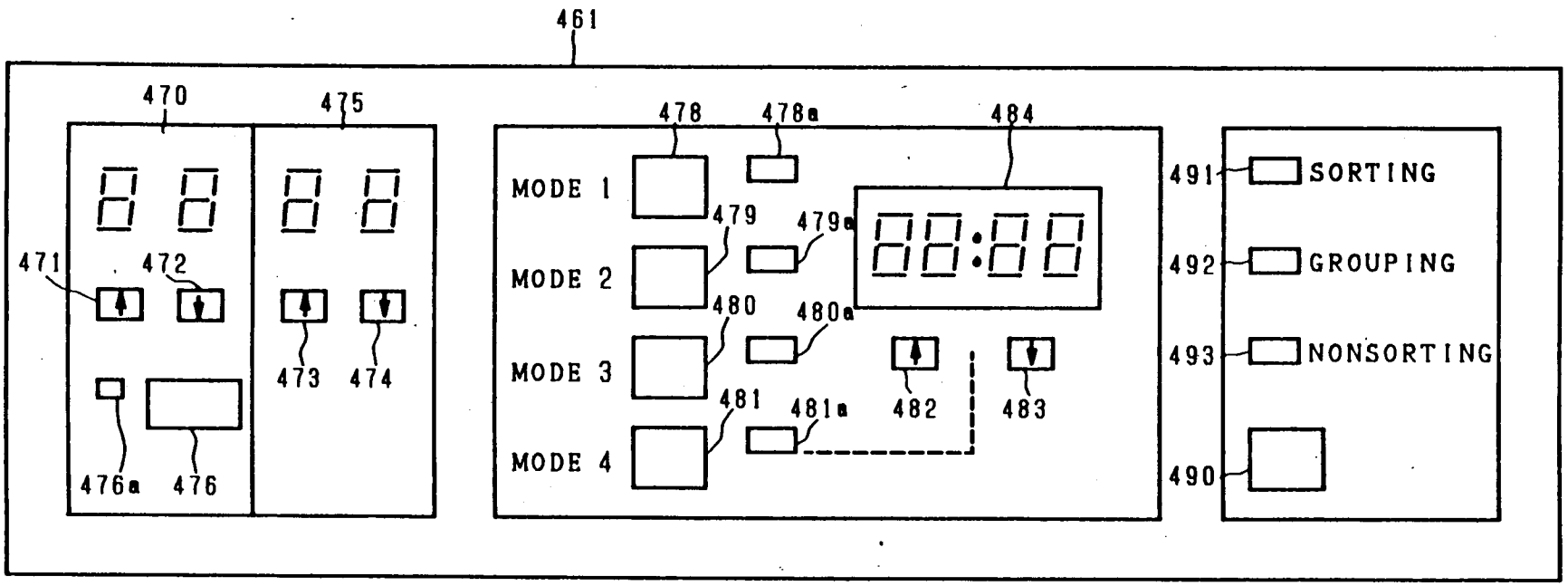

FIG. 5 shows operation panel 461 disposed on the DFU 401. The operation panel 461 comprises; a display 470 for indicating the number of copies for one sheet of a document, an increment key 471 and decrement key 472, a set key 476 for setting the number of copies, a display 476*a* for displaying the completion of setting the number of copies, a display 475 for displaying the number of document sheets, an increment key 473 and decrement key 474 for setting the number of document sheets, key switches 478, 479, 480, 481 for selecting processing modes (job modes) of a document, job displays 478*a*, 479*a*, 480*a*, 481*a*, a time display 484 for displaying the copying completion time, an increment key 482 and a decrement key 483 for the completion time settings, a key switch 490 for selecting processing modes (sorting modes) of the copied paper at the first and second sorters 600, 650 and displays 491, 492, 493 for displaying a sorting mode, grouping mode and non-sorting mode.

JOB MODE 1

After the operation of one DFU has been started in the job mode 1, the operation is not interrupted until the completion of the operation even when documents are set in the other DFUs. This mode is advantageous for the next user when the number of document sheets and copies is small.

JOB MODE 2

In response to setting documents in the other DFU while one DFU is operating in the job mode 2, the operation in the job mode 2 is interrupted after a preset number of copies from the document placed on the document table 35 are taken, and thereafter the DFU which is newly set documents start the operation thereof.

JOB MODE 3

In response to setting documents in the other DFU while one DFU is operating in the job mode 3, the operation in the job mode 3 is interrupted immediately after one copy being produced is taken, and thereafter the DFU which is newly set documents start the operation thereof.

In the job mode 4, the copying completion time of the set document can be designated.

Constructions of other operation panels 462 and 463 disposed on DFUs 402 and 403 we substantially as same as that of the operation panel 461.

Figure 6:
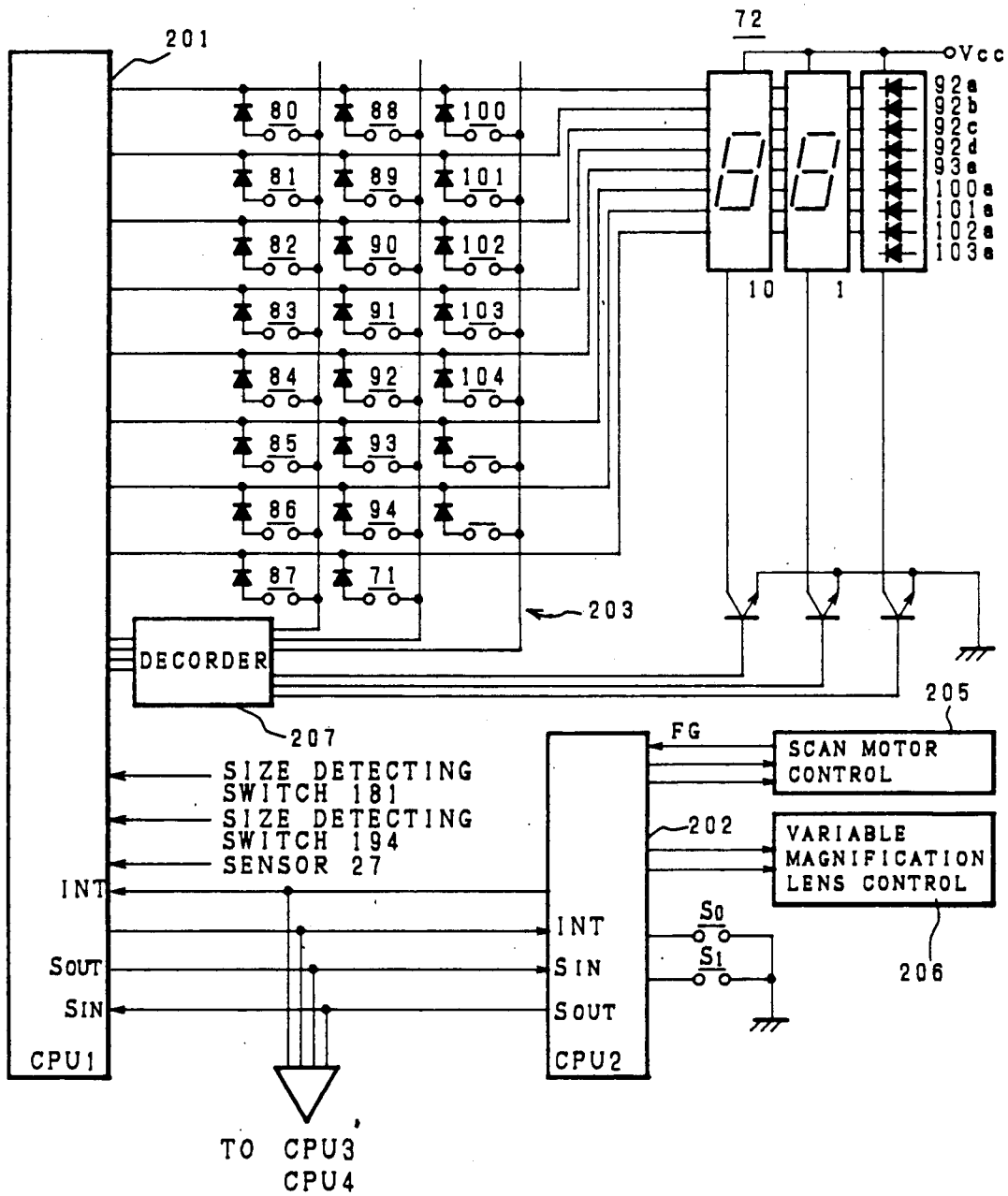
FIGS. 6, 7 and 8 are major portion block diagrams of control circuits thereof.
Figure 7:
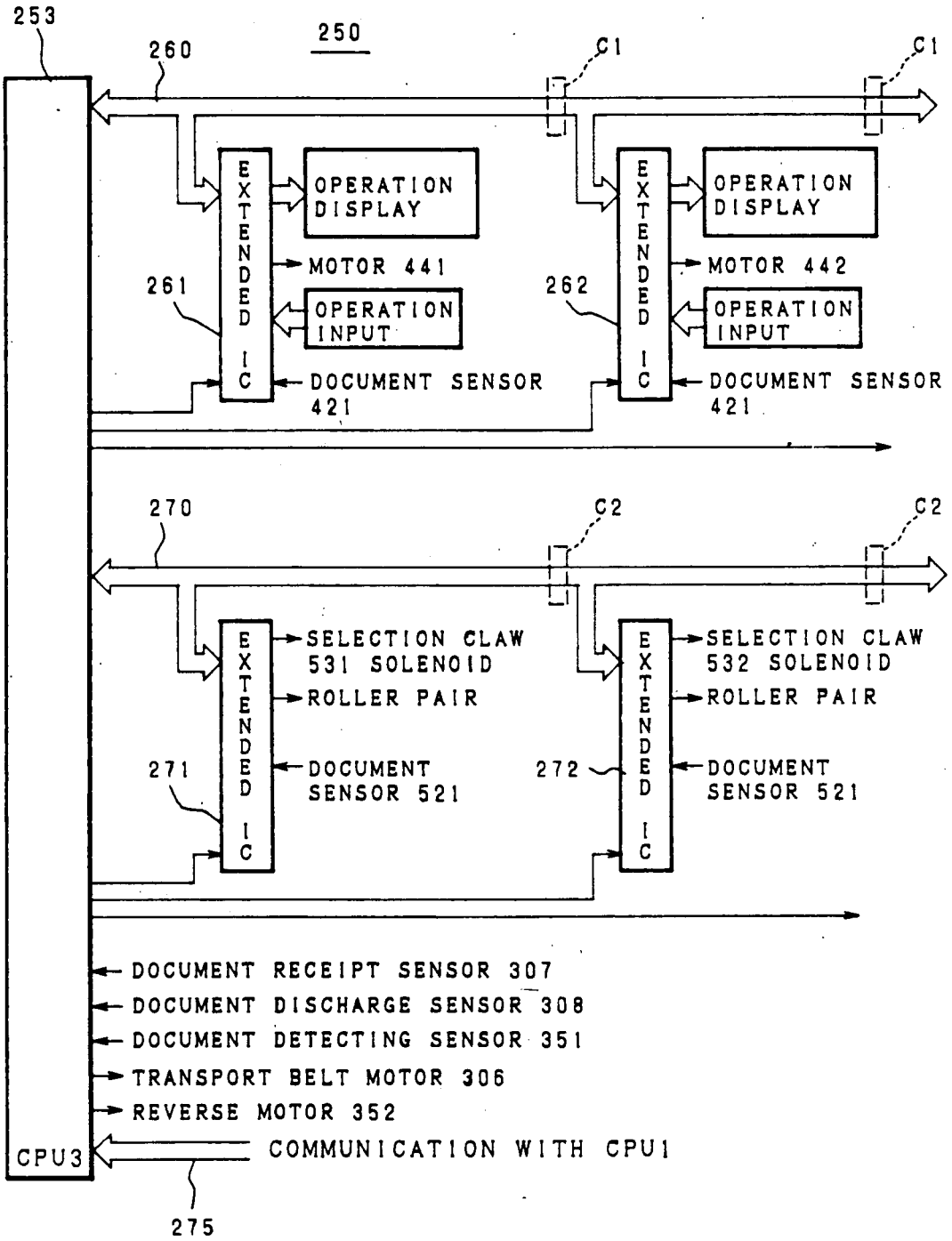
Figure 8:
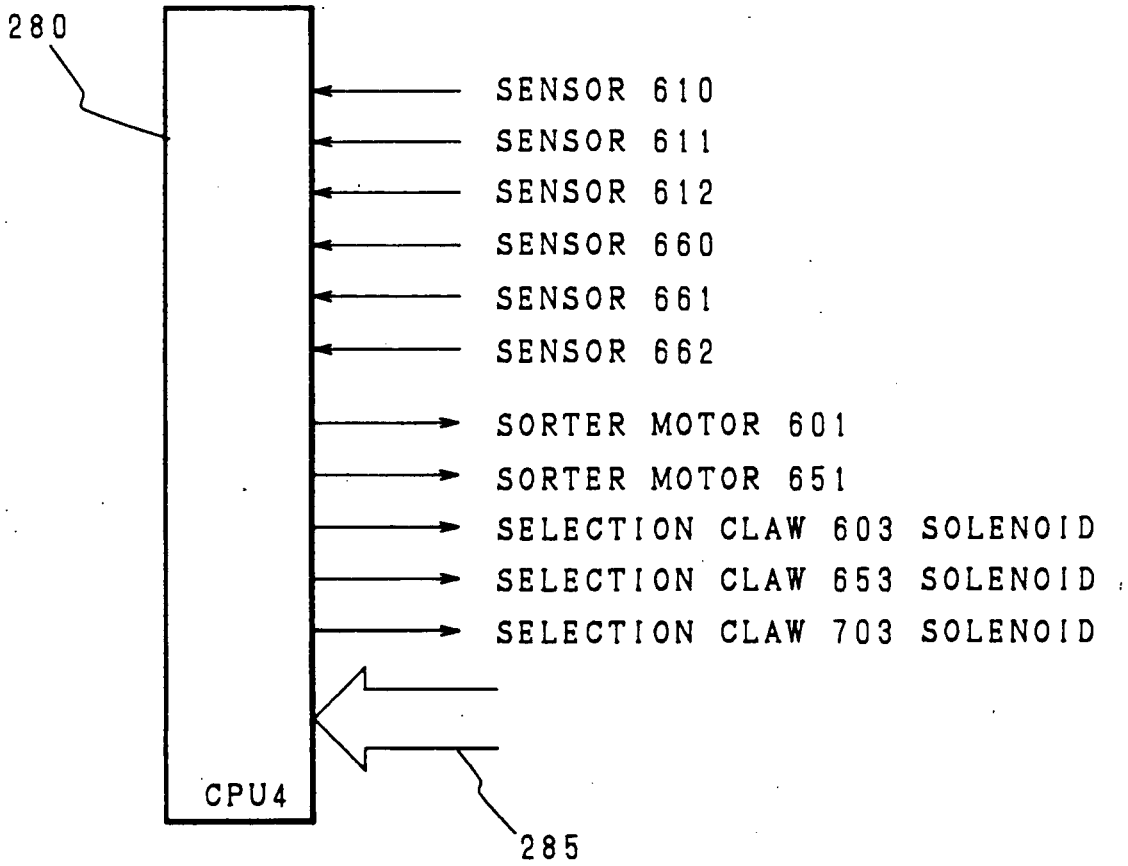

FIGS. 6, 7 and 8 are block diagrams of control circuits of the present apparatus which is comprising; a microcomputer 201 (CPU1) for controlling copying operation, a microcomputer 202 (CPU2) for controlling a scanning optical system, a microcomputer 253 (CPU3) for controlling the ADF 300 and a microcomputer 280 (CPU4) for controlling the first and second sorters.

The CPU1 (201) is connected through a decoder 207 to a switch matrix 203 comprising key groups of the operation panel and switches of various sensors, the copy number display 72 and light emitting diodes 92*a* to 92*d*, 93*a* . . . , 103*a* for various displays. The CPU1 (201) is also connected to the size detecting switches 181, 194 for detecting sizes of the paper to be copied and the sensor 27 for detecting the paper discharged from the paper outlet 26. An output port for controlling copying operation is connected with respective driving circuits (not shown) of a main motor, a developing motor, a timing roller clutch, clutches for upper and lower paper feed rollers 21, 22, a charger 3, a transfer charger 5 etc. In addition, an interrupt signal input terminal INT and data input/output terminals $S_{IN}$, $S_{OUT}$ are connected to the associated terminals of the CPU2 (202) such that communication of data is made mutually. The CPU2 (202) is connected with a scan motor control circuit 205 for controlling operation of the slider driving motor 17, a variable magnification lens control circuit 206 for controlling operation of the lens moving motor, scanning control sensors $S_0$, $S_1$ and so on.

FIG. 7 shows a block diagram of the CPU3 (253) for controlling the ADF 300. The CPU3 (253) is connected with a signal bus 260 for the document feed portion as well as a signal bus 270 for the document discharge portion. As for the document transport control portion, at least sensors 307, 308 and the document detecting sensor 351 of the R unit 350 are connected to an input port, and driving portions of a transport belt motor 306 and reversing motor 352 are connected to an output port.

The signal bus 260 is extensible through a connector portion C1 comprising a connector 401*c* and a connector 402*c* shown in FIG. 2. The signal bus 260 is connected with input/output extended ICs 261, 262 . . . incorporated in the respective DFU in parallel. For this extended IC, for example, a product 8243 of Intel Corporation may be used. The extended IC 261 is connected through a driver with displays on the operation panel of the DFU such as the copy number display 470, set completion display 476*a*, document number display 475, job mode displays 478*a* to 481*a*, time display 484 and sorting mode displays 491 to 493 etc., and also with operating portions such as keys 471 to 474, 476, 478 to 481, 490 etc. A document sensor 421 at the DFU 401 is connected to an input terminal, and a document feeding motor 441 is connected to an output terminal through the driver respectively. The extended IC 262 incorporated in the other DFU 402 and the DFU 403 are connected entirely in the same manner.

The signal bus 270 is also extensible through a connector portion C2 is the same way as the bus 260 aforementioned. The connector portion C2 comprises a connector 551*c* and a connector 552*c* shown in FIG. 3. To the signal bus 270, input/output extended ICs 271, 272 . . . incorporated in the respective document discharge units are connected in parallel. The extended IC 271 incorporated in the DDU 501 is connected in principle with a solenoid for operating a document sensor 521 and a document transport passage selection claw 531. The extended ICs of the other DDU 502, 503 . . . are also connected in the same manner.

FIG. 8 shows a block diagram of the CPU4 (280) for controlling the first and second sorters. To an input port of the CPU4 (280), the sensors 612, 662 for detecting the copied paper to be introduced into the first and second sorters 600, 650, the sensors 611, 661 for detecting the copied paper to be transported to the non-sorting tray, namely, the bridge 700 or the paper discharge portion 702 or the paper discharge tray 750, and the sensors 610, 660 for detecting the copied paper to be sent out to the sorting tray, namely, the bins 620 or 670 are connected, and to an output port thereof, the solenoid etc. for operating the sorting motors 601, 651 and selection claws 603, 653, 703 are connected.

The CPU3 and CPU4 are designed to make communication with the CPU1 through the buses 275 and 285.

FIG. 9 shows a RAM map defining memory areas of a RAM incorporated in the CPU3 (253). Numerals in each row correspond to unit numbers of each DFU, and numerals in each column correspond to various parameters such as existence of a document, a state in copying operation, a sequence number of copying operation, the number of copies, a discharge unit number, a job mode, the number of document sheets and a sorting mode. A section defined by an intersection of a row and a column has a length of one byte. Significations of each parameter are as follows. In the column "existence of document", "1" indicates the presence of a document and "0" indicates the absence thereof. In the column "under copying", "1" indicates that the document group concerned is being copied and "0" indicates that there is no document to be copied. The column "sequence number" indicates the sequence number of the document group of the DFU to be copied. The column "number of copies" indicates the number of copies for one sheet of a document group. The column "discharge unit number" indicates the number of a DDU to which the document fed from the DFU is discharged. The DDU is made to correspond, in advance, to a DFU with a one-to-one relation. The column "job mode" indicates the mode number shown in FIG. 5, and "0" indicates the state where the job mode is not set. The column "number of document sheets" indicates the number of document sheets set in respective DFUs. The column "sorter mode" is the number indicating the sorter processing mode for the copied paper whereon the document group is copied, and "1", "2" and "3" correspond respectively to the sorting mode, grouping mode and non-sorting mode.

In the following, control procedures of the CPU1, CPU3 and CPU4 will be explained on the basis of flow charts in FIG. 10 onward.

Before explaining the flow charts, terminologies ON-EDGE and OFF-EDGE will be defined as follows. ON-EDGE is defined as the change of state in which states of switches, sensors, signals etc. have changed from the OFF state to the ON state.

While, OFF-EDGE is defined as the change of state in which states of switches, sensors, signals etc. have changed from the ON state to the OFF state.

Figure 10:
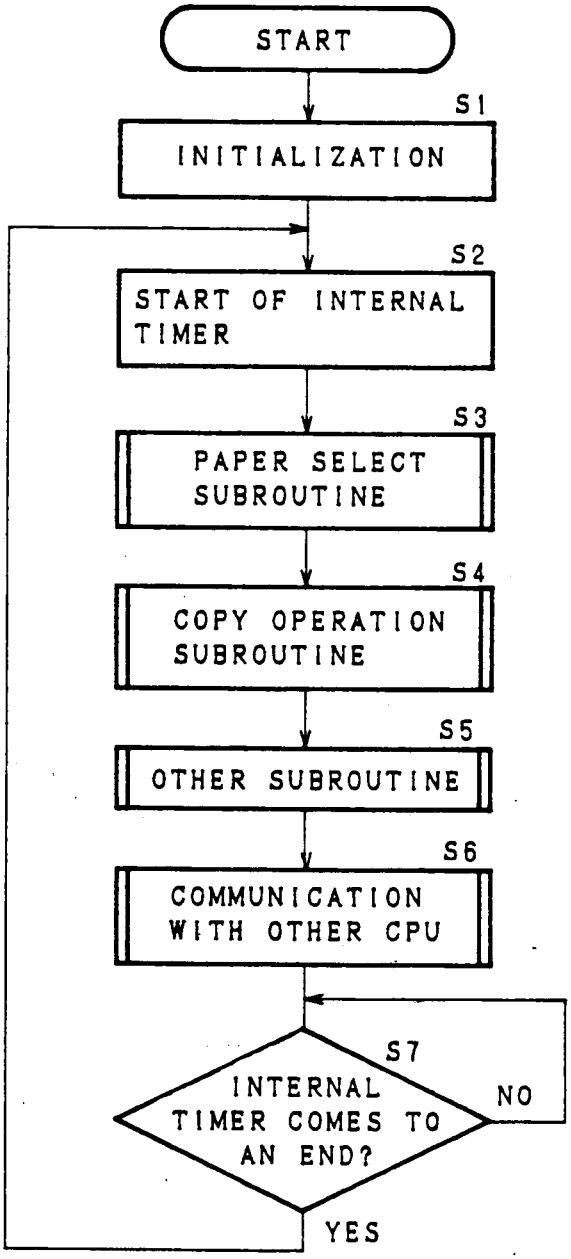
FIGS. 10 through 32 are flow charts showing control procedures of the CPU.

FIG. 10 shows a main routine of the CPU1. When the power source is applied and the CPU1 is reset to start the program. First, the CPU1 makes initialization in Step S1 to clear the RAM and to set the contents of various registers to initial values and respective devices to initial modes. Then, in Step S2, the CPU1 starts an internal timer. The internal timer decides the required time for one routine in the main routine independently of the processing content in respective subroutines to be described in the following, and its value is set, in advance, at initial setting in Step S1.

Next, the CPU1 calls subroutines shown in Steps S3 to S6 successively. When all the subroutines are processed, the CPU1 waits for an end of the internal timer in Step S7 and returns to Step S2. The CPU1 counts various timers used in respective subroutines by using the length of the period of one routine.

After having called all of the subroutines related to operations of the present apparatus, the CPU1 makes data communication with the CPU2, CPU3 and CPU4 in Step S6.

Figure 11:
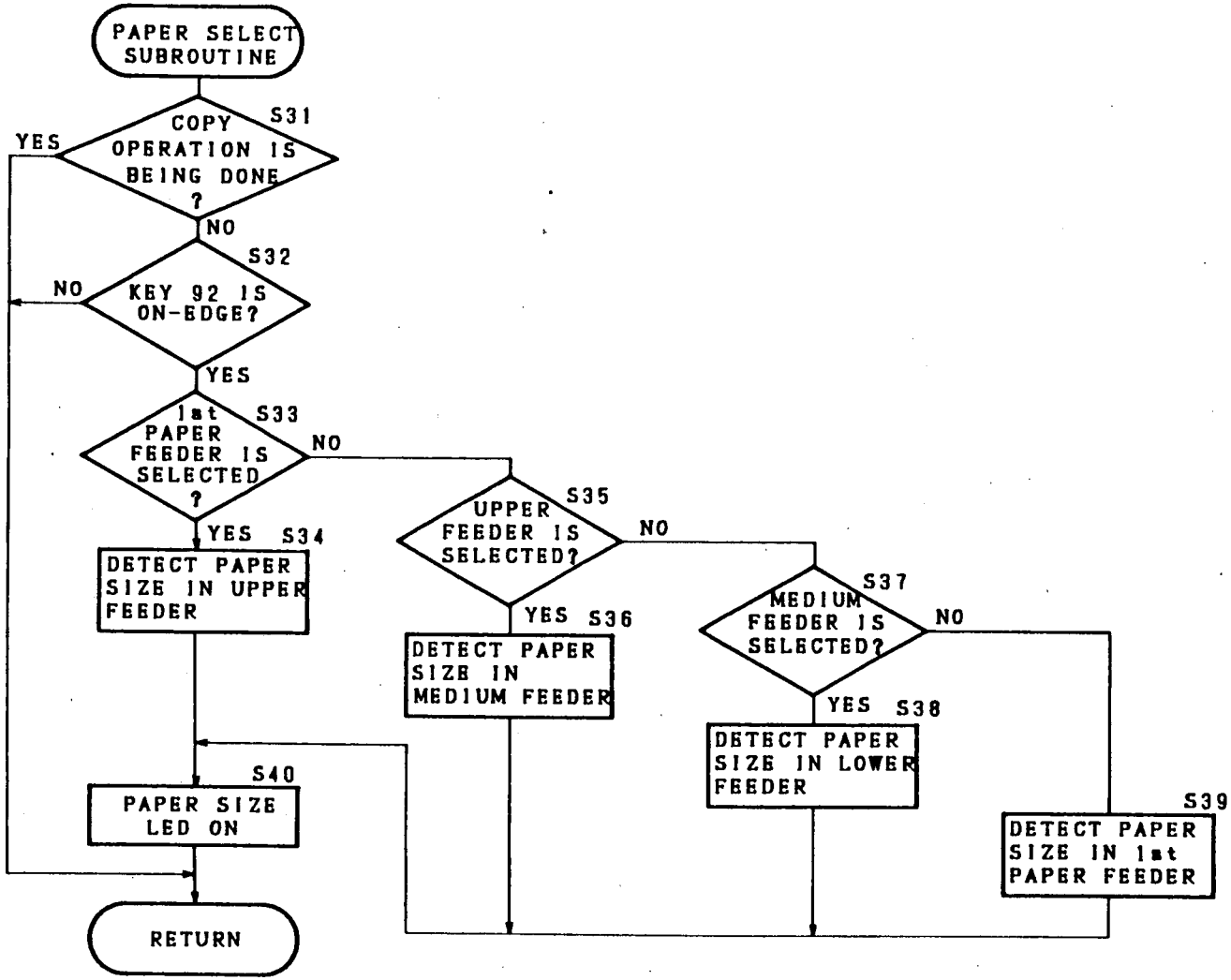

FIG. 11 shows a paper select routine in Step S3. When ON-EDGE of the paper select key 92 is detected when copying is not being done (Steps S31, S32), the CPU1 selects an upper stage paper feed portion of the three-stage paper feed unit 19 if the first paper feed (on the side of the cassette 18) is selected at present, selects a medium stage paper feed portion if the upper stage paper feed portion of the three-stage paper feed unit 19 is selected, selects the lower stage paper feed portion if the medium stage paper feed portion is selected, and selects the first paper feed if the medium stage paper feed portion of the three-stage paper feed unit 19 is selected, to detect the paper size being mounted by the size detecting switches disposed on respective paper feed portions (Steps S33 to S39), and to turn ON LEDs 92*a* to 92*d* for the detected paper sizes (Step S40). When the cassette is mounted on the second paper inlet in place of the three-stage paper feed unit 19, the upper and lower paper inlets are selected alternately by the same processings.

Figure 12:
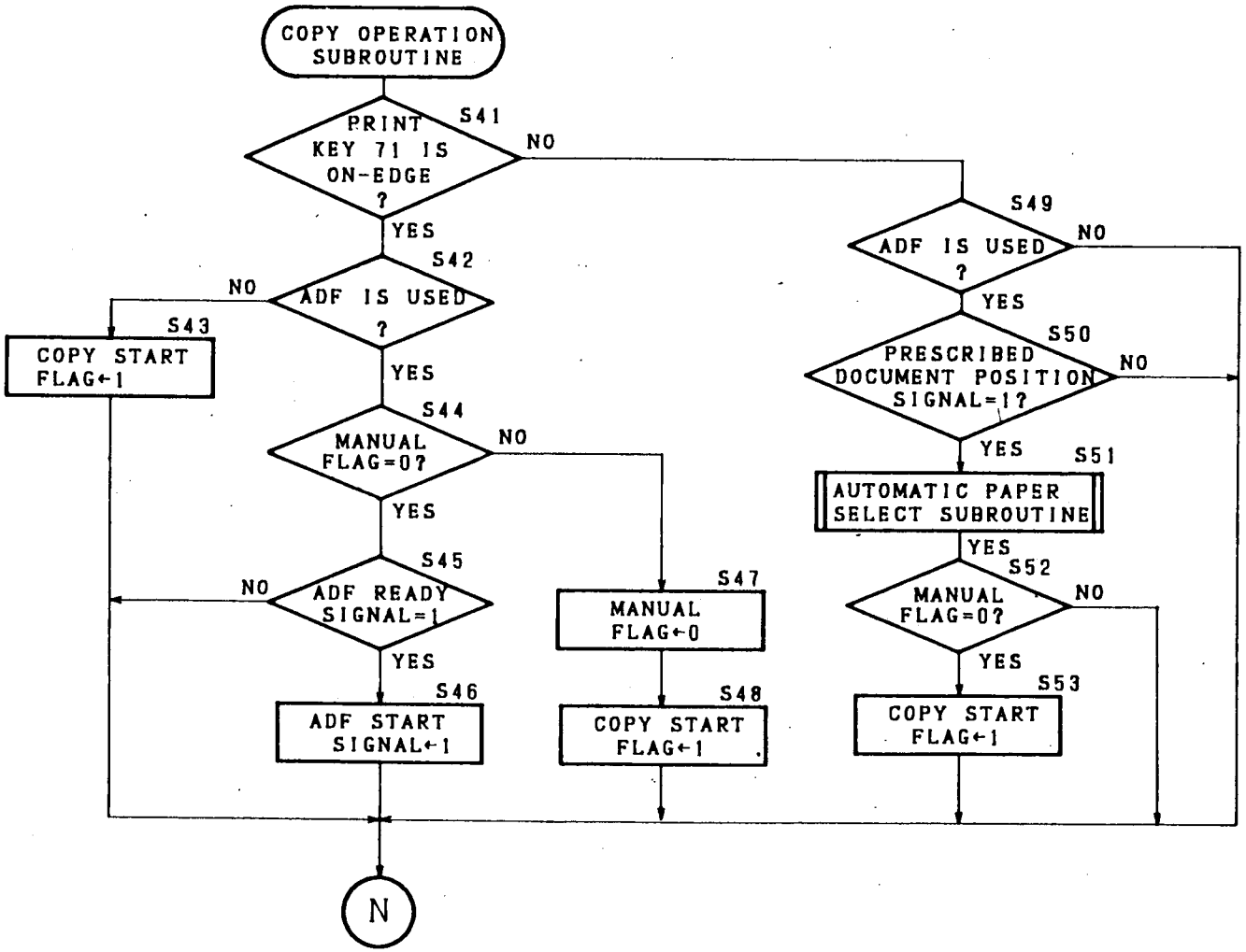
Figure 13A:
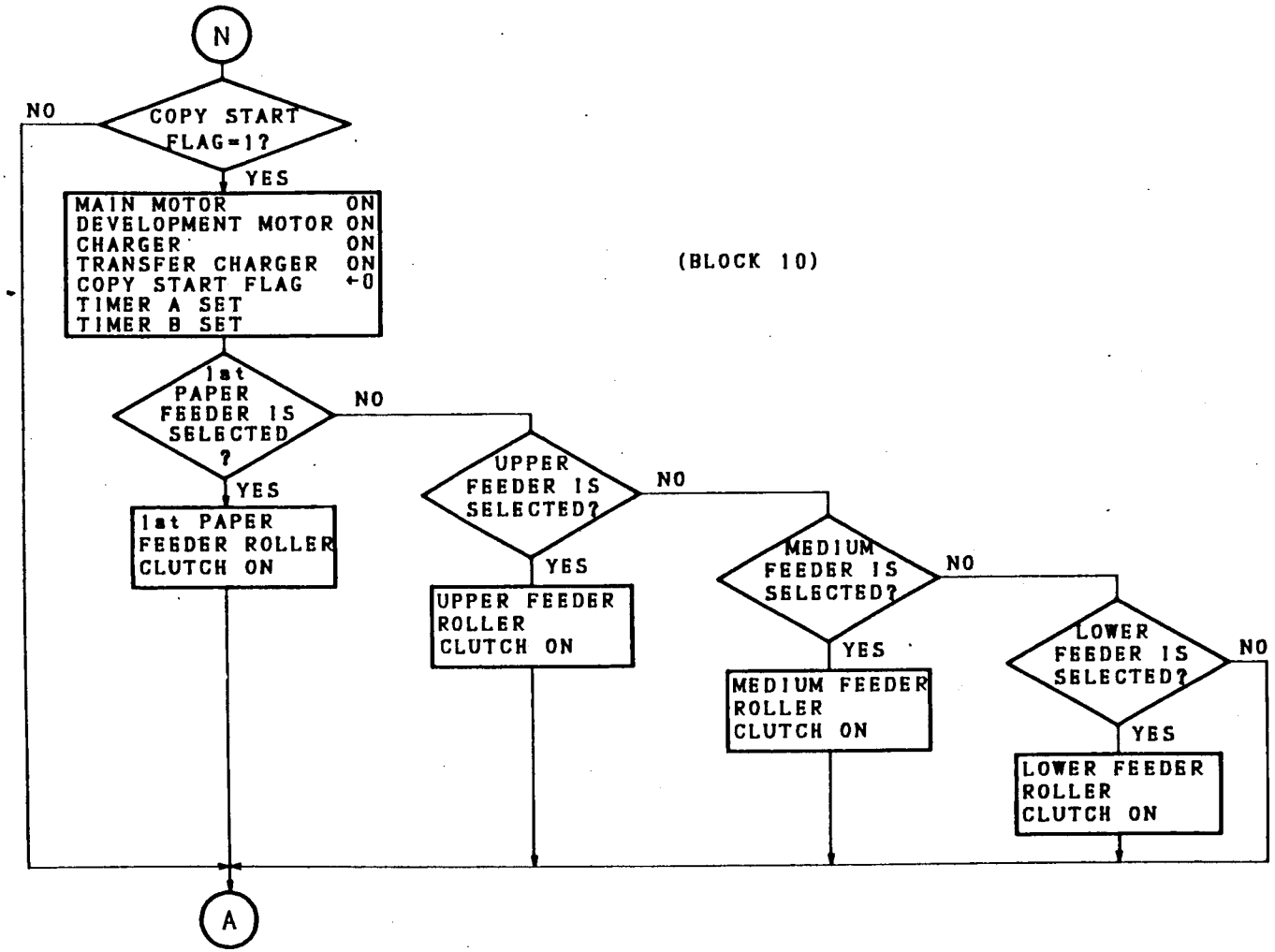
Figure 13B:
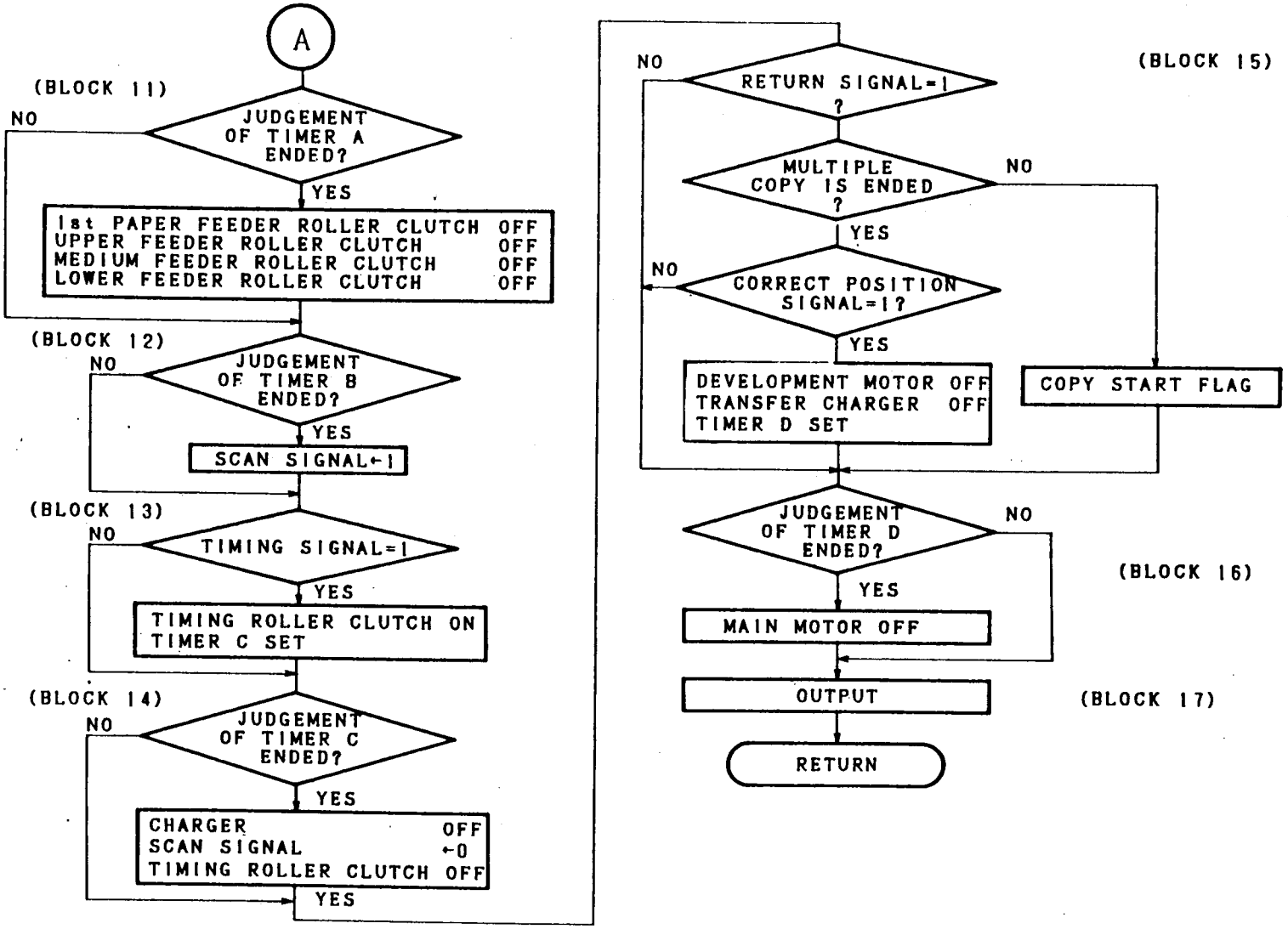

FIGS. 12 and 13 show details of a copying operation routine. At ON-EDGE of the print key 71 in Step S41, when an ADF is not installed, the CPU1 immediately sets a copy start flag to "1" (Step S43). If the ADF is used, the CPU1 determines the ADF ready signal from the ADF when a manual flag is "0". If the manual flag is "1", the CPU1 sets the ADF start signal to "1" (Steps S44 to S46). The manual flag is set when suitable paper can not be found by an automatic paper selection APS.

On the other hand, if the manual flag is "1", the CPU1 returns the manual flag to "0" by turning ON the print key 71 and sets the copy start flag to "1" (Steps S47, S48).

When the print key 71 is not ON-EDGE and the ADF is used, the CPU1 judges a prescribed document position signal from the ADF in Step S50, and when the signal becomes "1", the CPU1 searches for a cassette containing paper of a suitable size in the automatic paper select routine (Step S51). If paper of a suitable size is found by the search (manual flag="0"), the CPU1 sets the copy start flag to "1" (Step S53).

Then, in FIG. 13, the CPU3 first judges the copy start flag. When it becomes "1", the CPU3 turns ON the main motor, development motor, charger 3 and transfer charger 5, and at the same time, turns ON the roller clutch CL at the selected paper inlet, returning the copy start flag to "0", and sets a timer A(T-A) and a timer B(T-B) respectively (Block 10). The timer A controls the ON time of the clutch of paper feed roller of either the paper feed roller 20 or the three-stage paper feed unit. The timer B controls the start of scanning. In Block 11, the CPU3 determines the timer A and turns OFF the paper feed roller clutch at its time-up. In Block 12, the CPU3 judges the timer B and sets the scan signal to "1" at its time-up. In Block 13, the CPU3 turns ON the clutch of the timing roller 22 and sets a timer C(T-C) when the timing signal becomes "1". The timer C controls operation of the timing roller 22. In Block 14, the CPU3 judges completion of the timer C and turns OFF the charger 3, scan signal and timing roller clutch at its time-up. In Block 15, the CPU1 judges the state "1" of a return signal emitted when the first slider tries to return to a home position. When the return signal becomes "1", the CPU1 judges whether or not copying operation for multiple copying is completed, if it is not completed, the CPU1 sets again the copy start flag to "1". If the copying operation is completed, the CPU1 waits for the prescribed position signal emitted when the first slider returns to the home position, then turns OFF the development motor and transfer charger 5 and sets a timer D(T-D). In Block 16, the CPU1 judges an end of the timer D and turns OFF the main motor at its time-up. In the final Block 17, the CPU1 outputs a logical signal for real operation.

Figure 14:
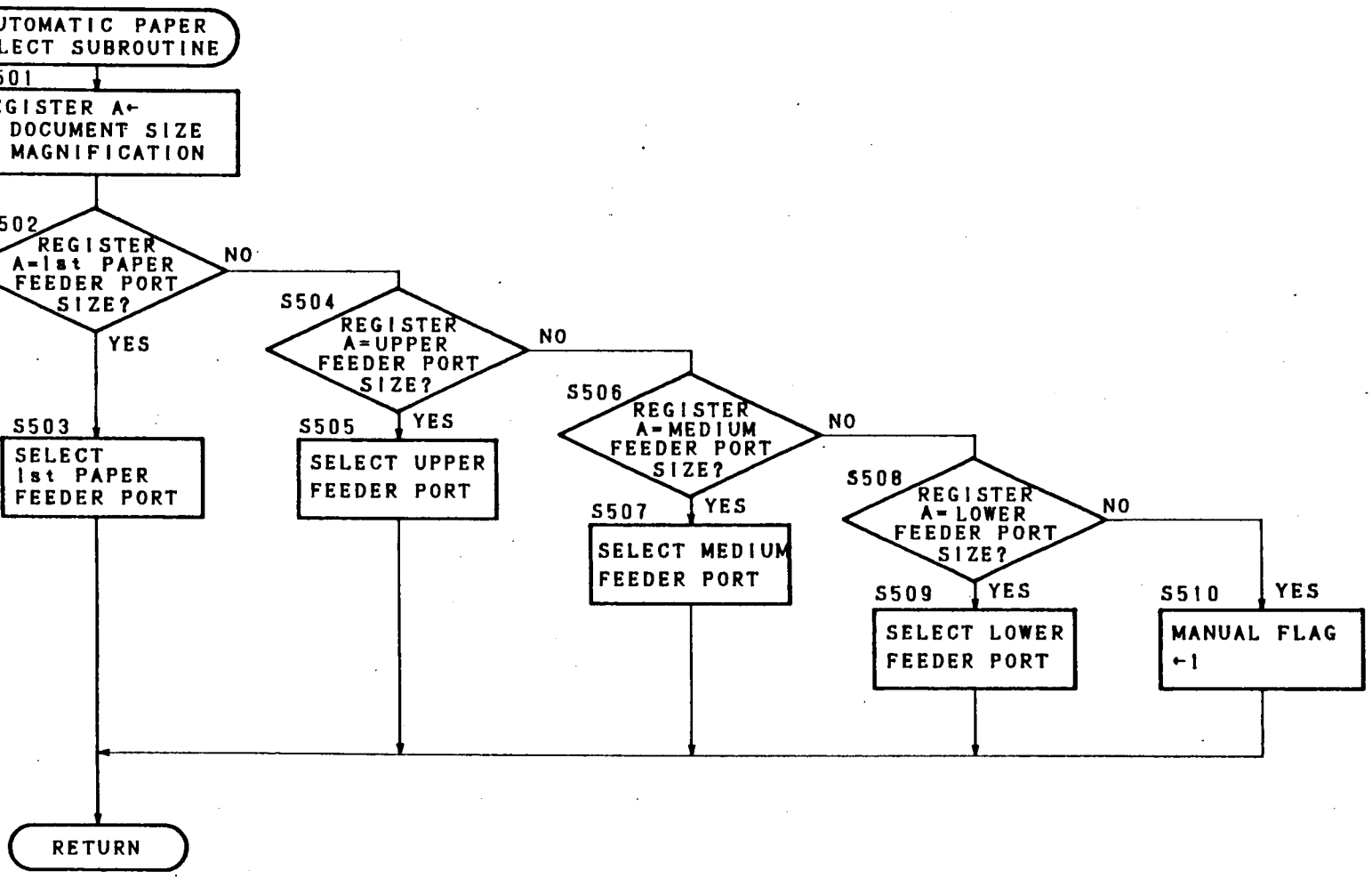

FIG. 14 shows a flow chart of the automatic paper select routine in the copying operation routines aforementioned. In Step S501, the CPU1 stores a result of multiplication of the document size and the magnification in a register A. Then, the CPU1 compares the content of the register A and the real size data of the paper size in the upper paper inlet and the paper inlet of the three-stage paper feed unit to select the paper inlet if it is appropriate (Steps S502 to S509). If it is not appropriate, the CPU1 sets the manual flag in Step S510 and returns to the main routine.

Figure 15:
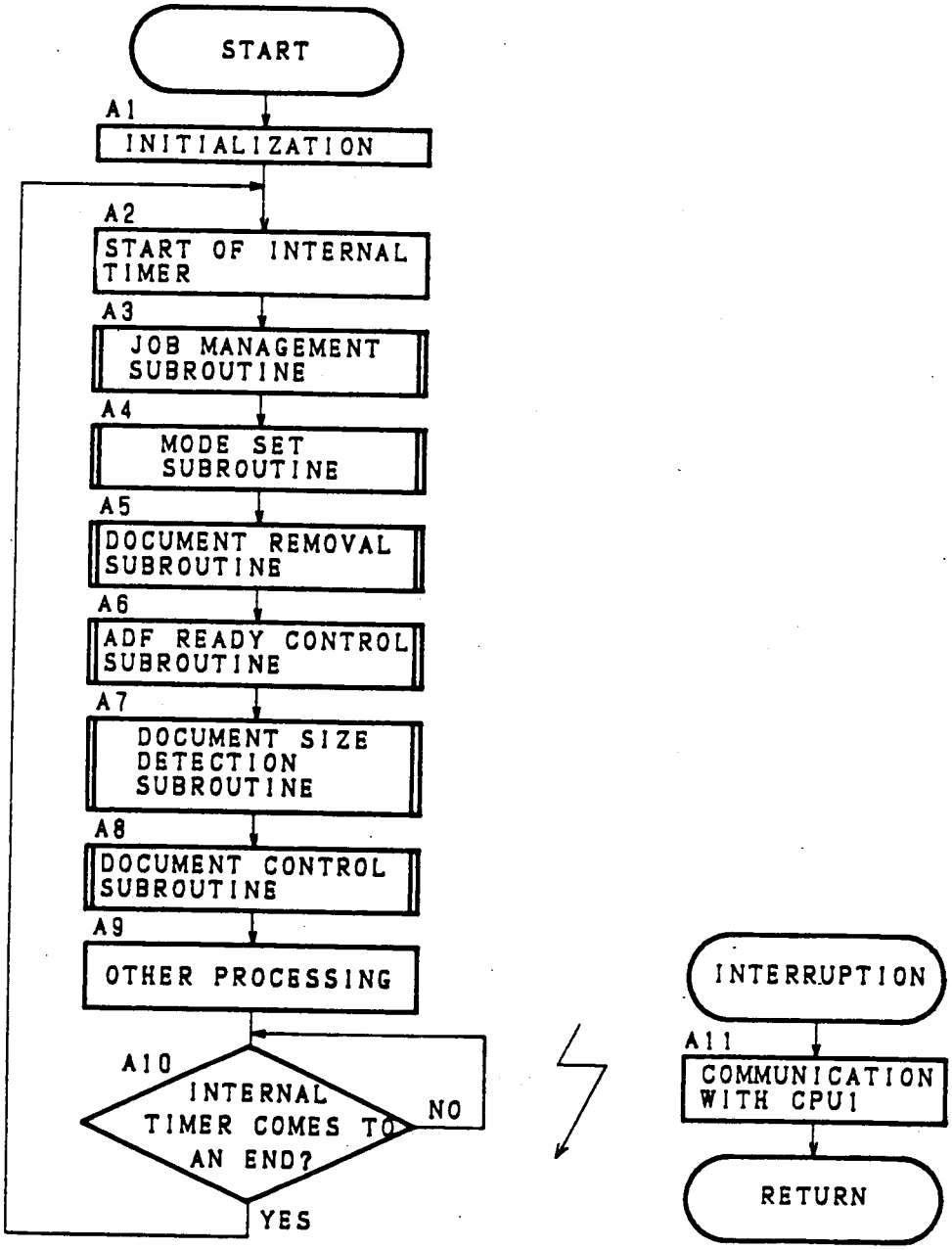

FIG. 15 is a general flow chart of a program of a CPU3 (253) controlling operation of the ADF. When the program starts, the CPU3 performs initial setting in Step A1 to clear the incorporated RAM and to set the contents of various registers. Then, the CPU3 starts the internal timer and calls successively the subroutines (Steps A3 to A9) shown in the flow chart. The CPU3 judges completion of the internal timer in the final Step A10 and when the internal timer is completed, it starts the timer again (Step A2) and executes the loop repeatedly.

Data communication between the CPU3 and the CPU1 is made by an interrupt routine according to an interrupt request INT from the CPU1 independently of the main routine.

Figure 16:
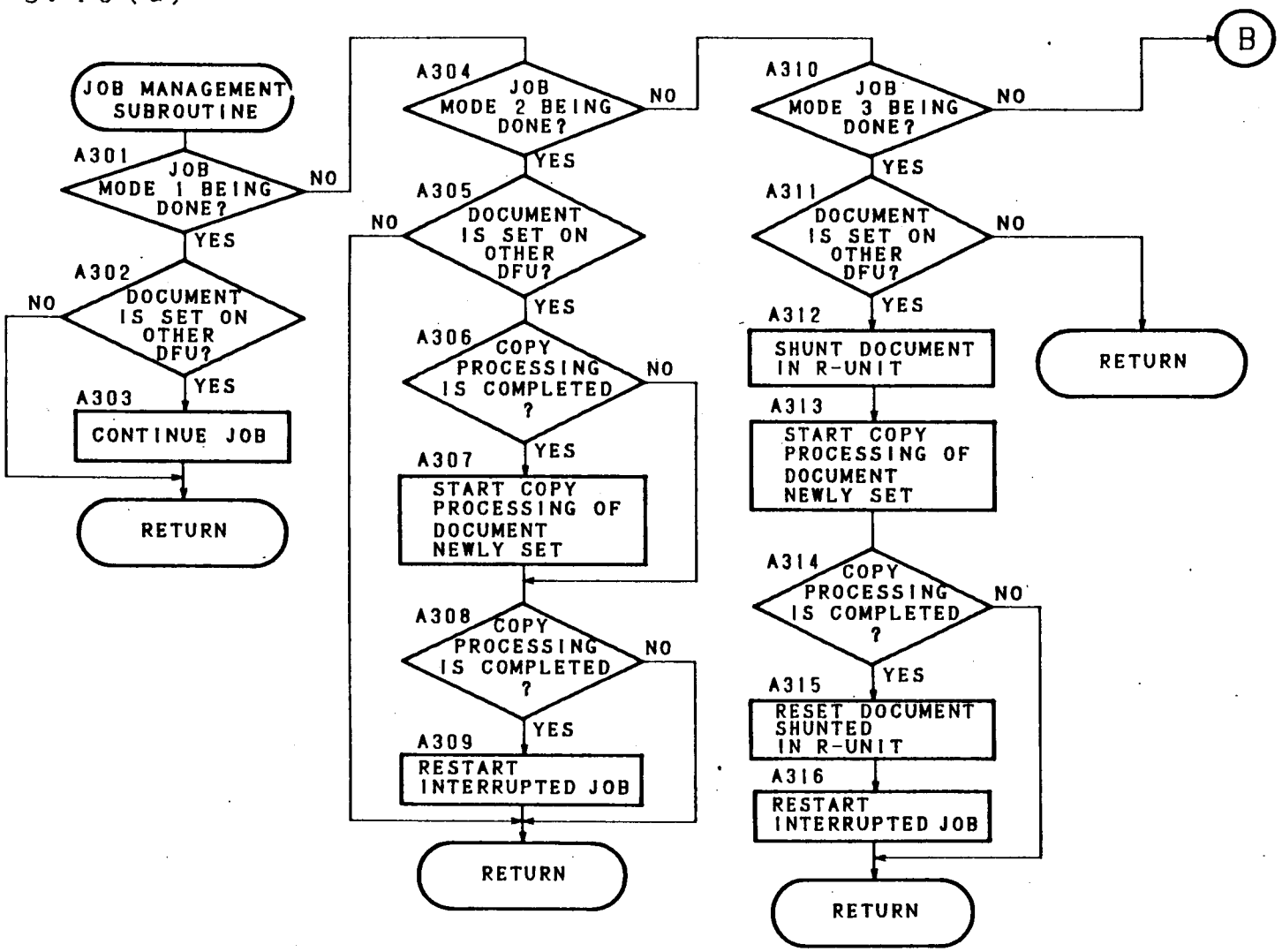
Figure 16B:
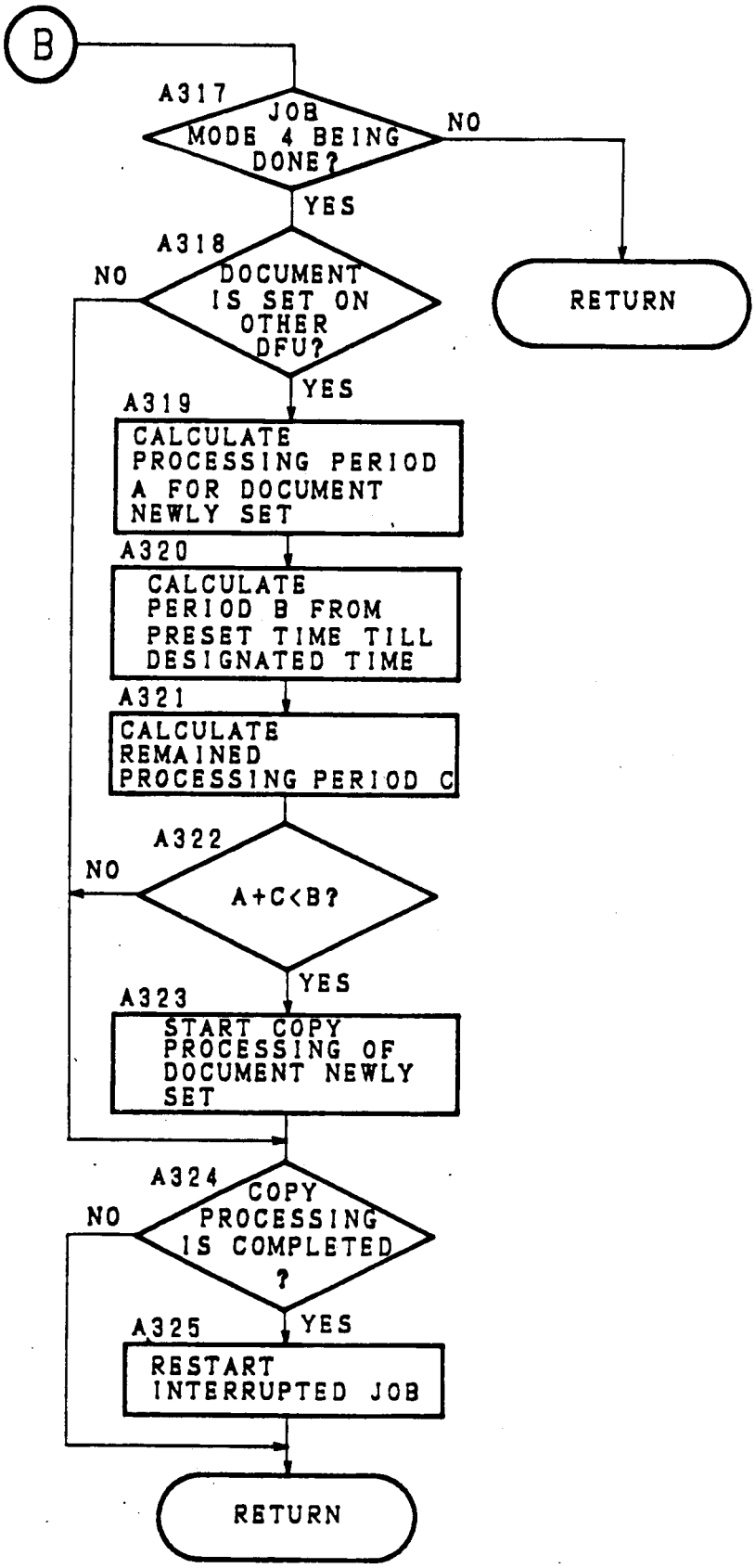

FIG. 16 shows a job control routine in Step A3. First, in Steps A301, A304, A310, A317, the CPU3 judges whether or not any of the DFUs is operating in any of the job modes 1 to 4.

When documents are set in the other DFU while a certain DFU is executing the job in the job mode 1, the CPU3 continues the job being executed, or completes its own processing neglecting the document newly set (Steps A302, A303).

When the job in the job mode 2 is being executed, the CPU3 judges whether or not copying of a predetermined number of copies for a sheet of document being copied at that point of time is completed. When it is not completed, the CPU3 completes the predetermined number of copies and thereafter interrupts the job in the job mode 2 and starts copying documents newly set in the other DFU, and when the new job is completed, again starts the job which has been interrupted (Steps A304 to A309).

When the job in the job mode 3 is being executed, the CPU3 interrupts the job after completing copying of one copy for a sheet of document being copied at that point of time, and shunts the document in the R unit 350 (Steps A310 to A312).

Then, the CPU3 starts copying documents newly set and when the new job is completed, resets the document shunted in the R unit 350 on the document table 35 and restarts the job which has been interrupted (Steps A313 to A316).

When the job in the job mode 4 is being executed, first, the CPU3 calculates the processing period A for documents newly set in the other DFU, on the basis of the number of document sheets set on the operation panel of the DFU (Steps A317 to A319). Then, the CPU3 calculates the period B from the present time till the designated time and the remained processing period C of the job (Steps A320, A321). In Step A322, the CPU3 judges whether or not $A+C<B$, namely, processing for documents newly set can be received and the job being executed at present can be completed till the designated time. When it is possible, the CPU3 interrupts the job being executed and starts copying for the documents newly set (Step A323). When this is completed, the job being interrupted is restarted (Steps A324, A325).

Figure 17:
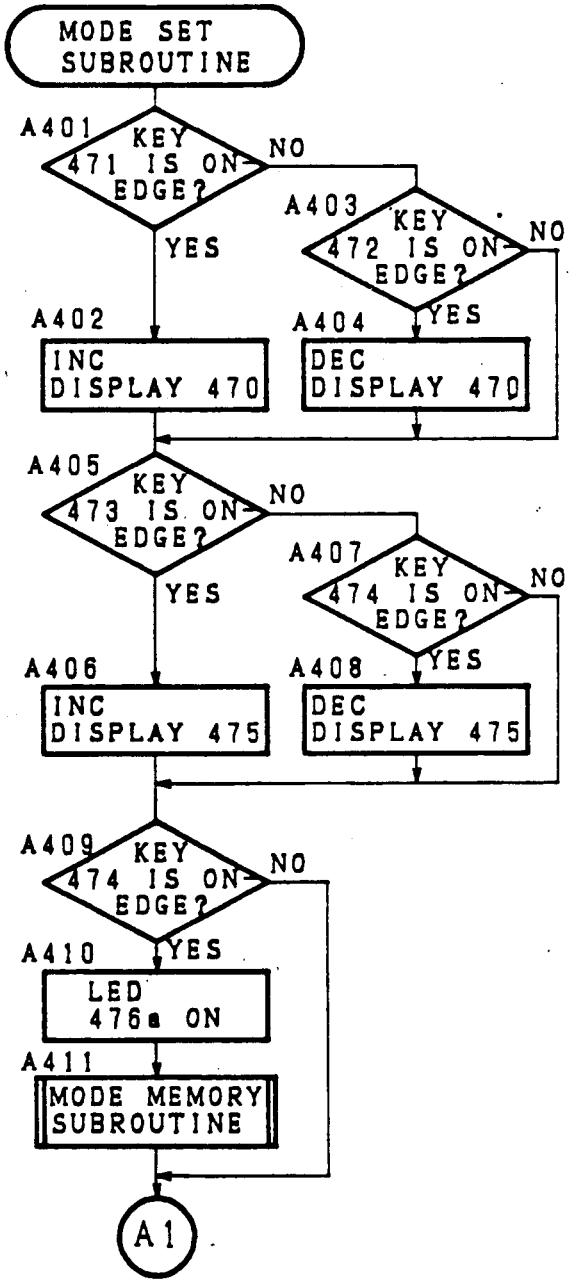
Figure 18:
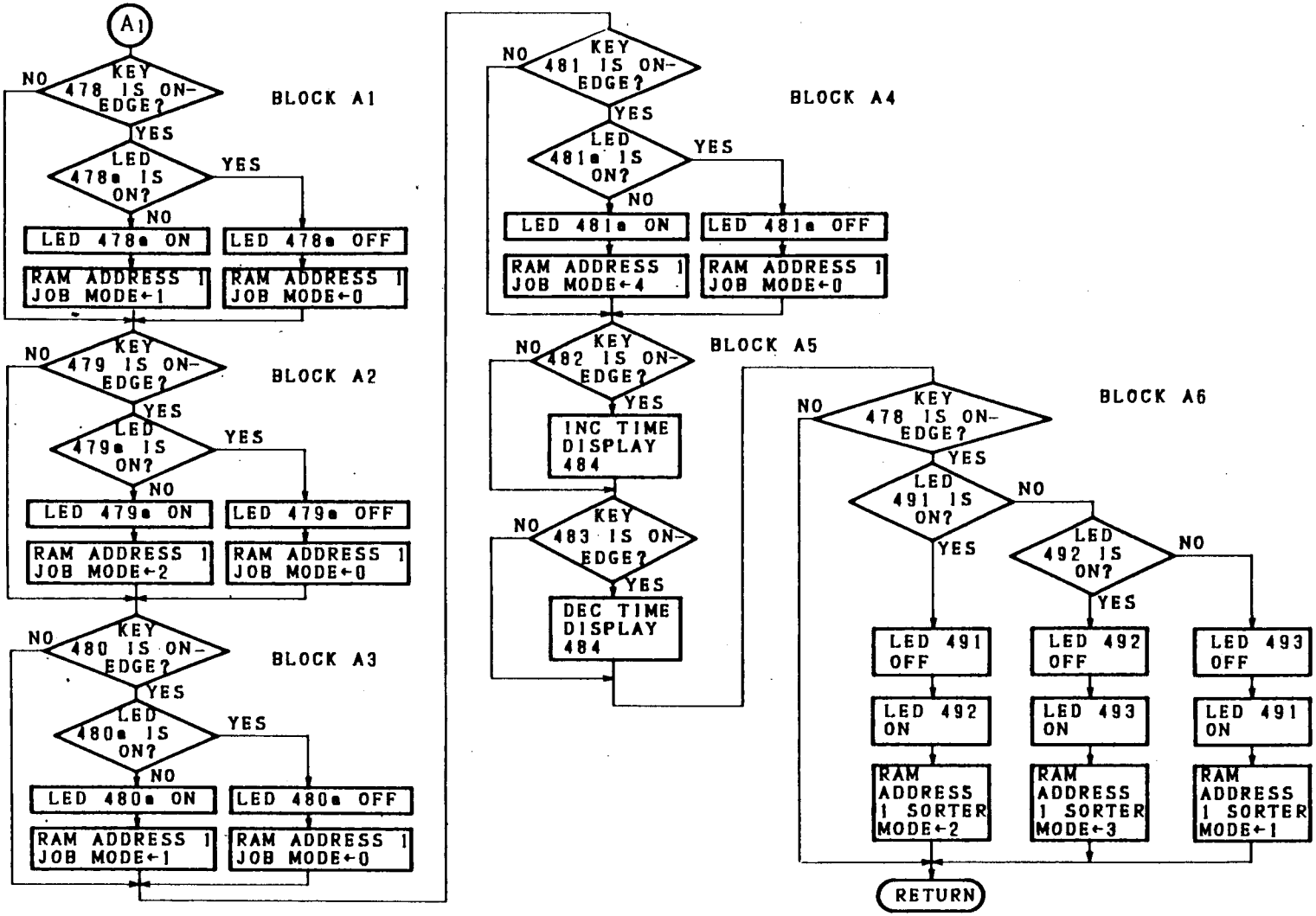

FIGS. 17 and 18 show the mode set routine of Step A4 for setting the aforesaid job mode and sorter mode, in which processings for defining memory areas in the RAM map shown in FIG. 9 by data based on input operation and calculation are shown.

First, in Step A401 or Step A403, displayed numeral of the number of copies on the display 470 is incremented (or decremented) by ON-EDGE of the key 471 (or 472) (Step A402 or A404). Then, by Steps A405 to A408, displayed numeral of the number of document sheets on the display 475 is similarly incremented (or decremented). The CPU3 turns ON the display (LED) 476*a* by ON-EDGE of the set key 476 (Step A409) and executes a mode memory routine (Step A411).

The job mode and sorter mode are selected and set by Blocks A1 to A6 shown in FIG. 18.

First, when the LED 478*a* (or LED 479*a*, 480*a*, 481*a*) is OFF by ON-EDGE of the key 478 (or 479, 480, 481), the CPU3 turns it ON and sets the job mode of a RAM address 1 to "1" (or "2", "3", "4"). Here, the case where a document is set in the DFU 401 is shown as an example, and the RAM address N (="1") corresponds to the DFU number N (="1"). On the other hand, when the LED 478*a* (or LED 479*a*, 480*a*, 481*a*) is ON, the CPU3 turns it OFF and sets the job mode of the RAM address 1 to 0 or releases setting of the job.

In Block A5, the displayed time on the display 484 is upped (or downed) by ON-EDGE of the key 482 (or 483) and the copying completion time is set.

In the next Block A6, the CPU3 sets the sorter mode. When the LED 491 is ON by ON-EDGE of the key 490, the CPU3 turns it OFF and turns ON the LED 492, setting the sorter mode of the RAM address 1 to 2 or setting to the grouping mode, and when the LED 492 is ON, the CPU3 turns it OFF and turns ON the LED 493, setting the sorter mode to 3 or to the non-sorting mode. When the LED 493 is ON, the CPU3 turns it OFF and turns ON the LED 491, setting the sorter mode to 1 or to the sorting mode.

Figure 19:
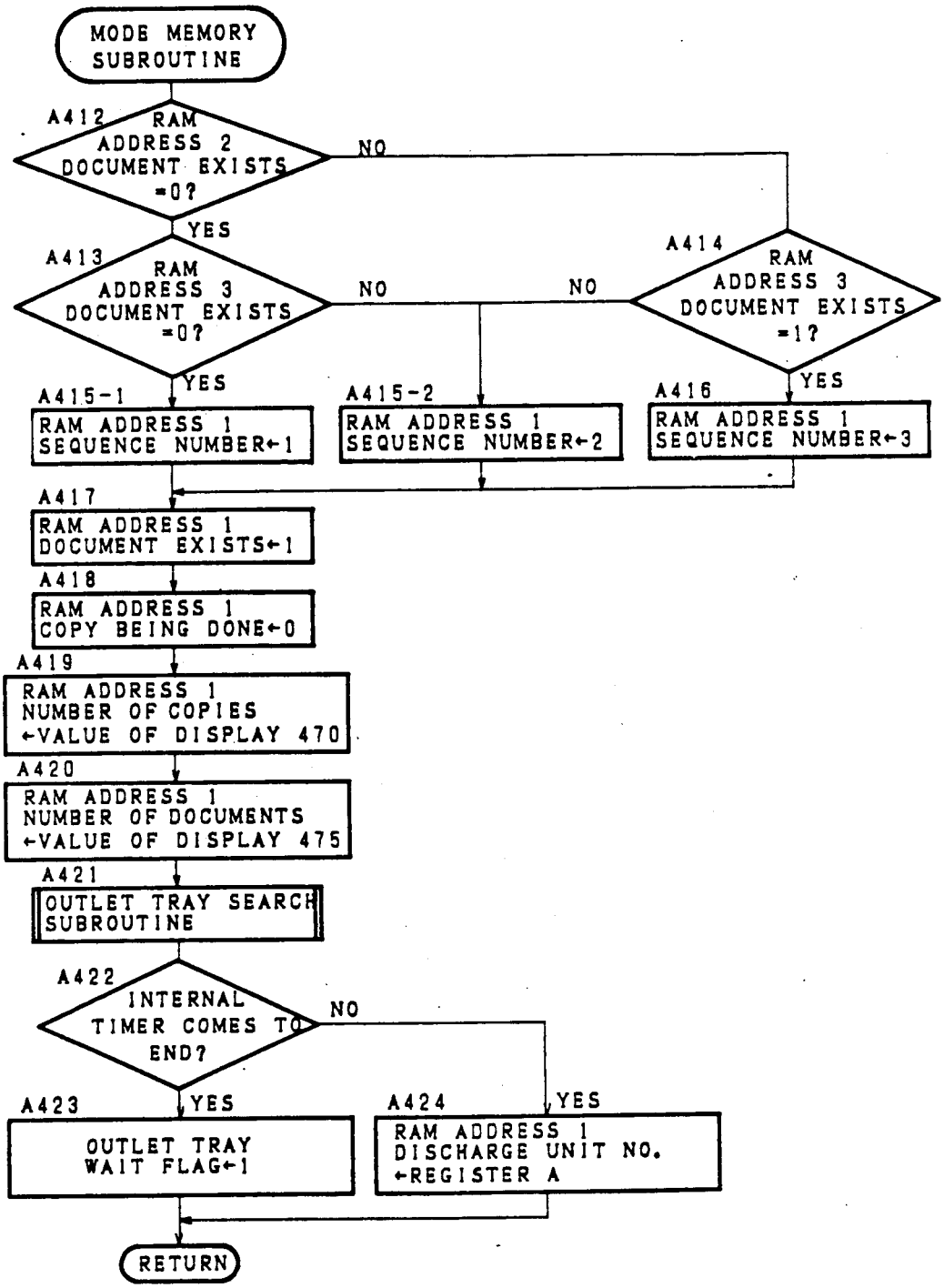

FIG. 19 shows the mode memory routine. First, in Steps A412 to A416, by whether or not a document is set in the other DFUs 402, 403, the sequence number of copying of the document is decided. That is, the CPU3 checks data of the document existence area of the RAM addresses 2, 3, and if they are "0" "0", sets "1" if they are "0" "1", sets "2" and if they are "1" "1", sets "3" in the sequence number area of N="1". That is, in the present embodiment, the copying sequence usually corresponds to setting order of the documents. When the sequence number is set, the CPU3 sets "1" in the document existence, "0" during copying, the numeral of display 470 in the area of the number of copies and the numeral of display 475 in the area of the number of document sheets respectively (Steps A417 to A420). Then, the CPU3 calls a discharge tray search routine shown in FIG. 20 to decide discharging end of the document, and stores the value of the register A in the discharge unit number area of the RAM address 1. If the register A is "0" or the documents exist in every discharge unit trays, the CPU3 sets the discharge tray wait flag to "1" (Steps A421 to A424).

Figure 20:
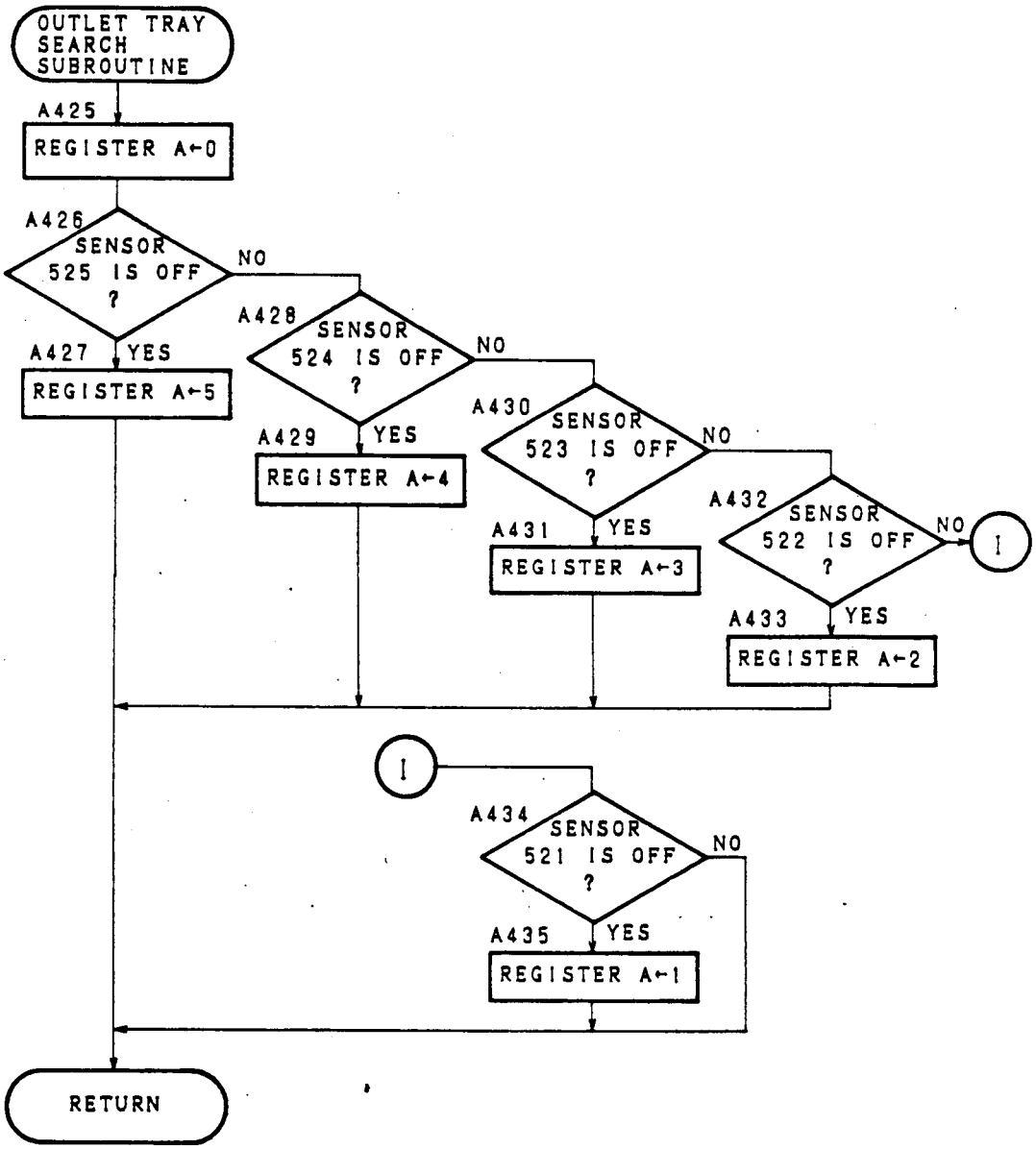

FIG. 20 shows a discharge tray search routine. First, the CPU3 resets the register A in Step A425 and sets values 5, 4 . . . 1 in the register A by OFF of the document existence sensors 525, 524 . . . , 521 of the discharge tray or by absence of the document (Steps A426 to A435). As can be seen from this flow chart, the discharge trays are allocated automatically in a preferential basis successively from the top to the bottom. This is because that, as same as the sorter according to the subject matter of the present invention, the higher the document is placed, the easier the removal thereof by the user.

When processing of the mode set routine in Step A4 (FIG. 17) in FIG. 15 is completed as aforementioned, the CPU3 then calls a document removal routine in Step A5. In this routine, when the document set is removed on the way for some reason, for example, the sequence number of the document coming later than the sequence number of the document removed is automatically moved up, thereby it is made possible to prevent a loss of time caused by processing judgment for the removed document.

Figure 21:
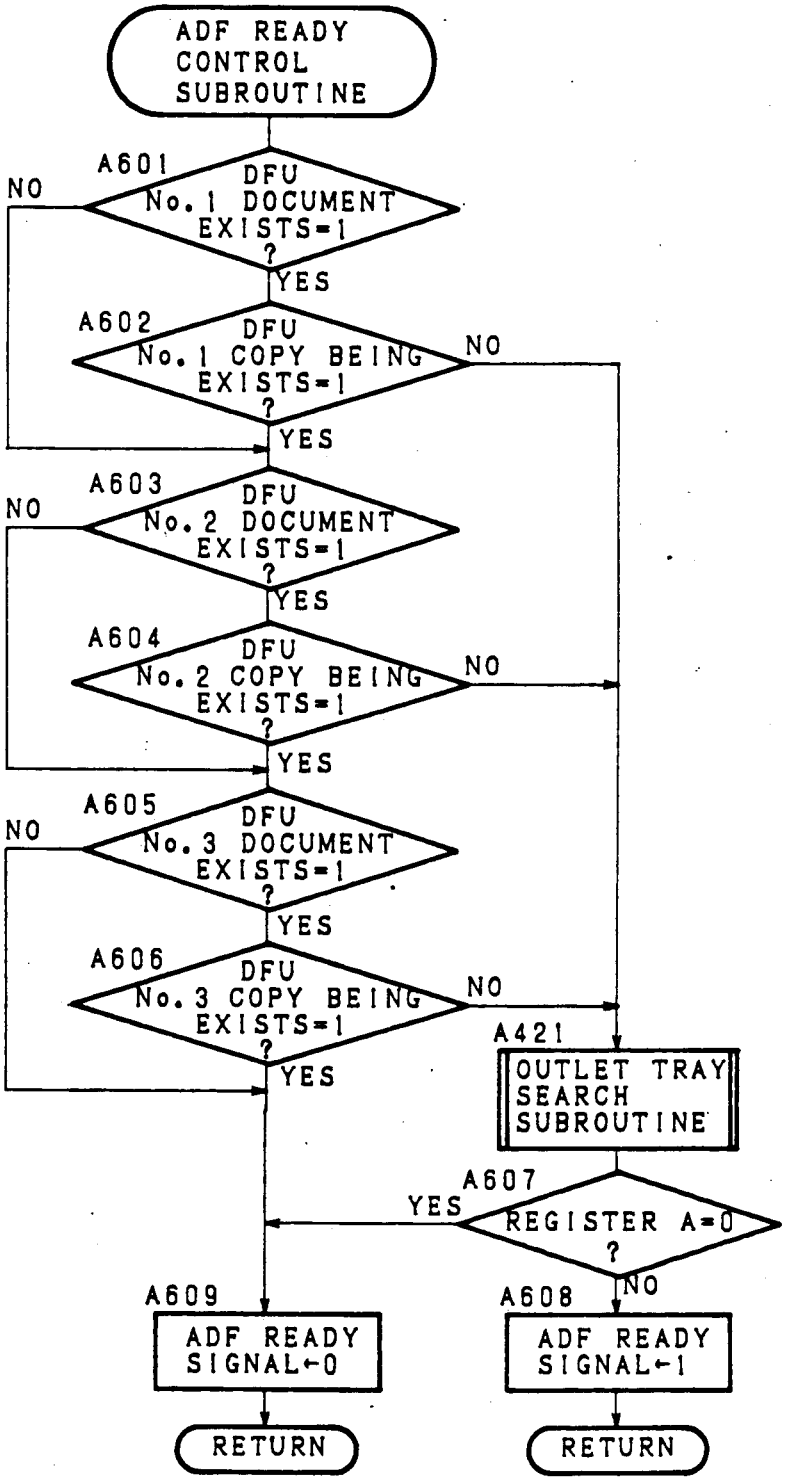

Step A6 is an ADF ready control routine for informing from the ADF 300 to the present apparatus whether or not the ADF 300 itself is ready to start. As shown in FIG. 21, if a document is set in any of the document feed trays and any of the document discharge tray is empty, the ADF is ready to start and the CPU3 sets the ADF ready signal to "1". On the other hand, if the ADF 300 can not be started at present, the CPU3 sets the ADF ready signal to "0" (Step A609). The ADF ready signal is set to "1" only when the CPU3 judges whether a document exists in any of the document feed trays by "1" of "document existence" on the RAM map, and when the CPU3 further judges that a document does not exist in any of the discharge tray by the discharge tray search routine when the document is not being copied (not "1") (Step A608).

Step A7 is a document size detection routine, which employs an APS (automatic paper selection function) or an AMS (automatic magnification selection function) and is called when the document size is judged automatically. In this routine, a standard document size is judged by detecting a range to which a real size of the document belongs by using a sensor 306 and a software timer.

Figure 22:
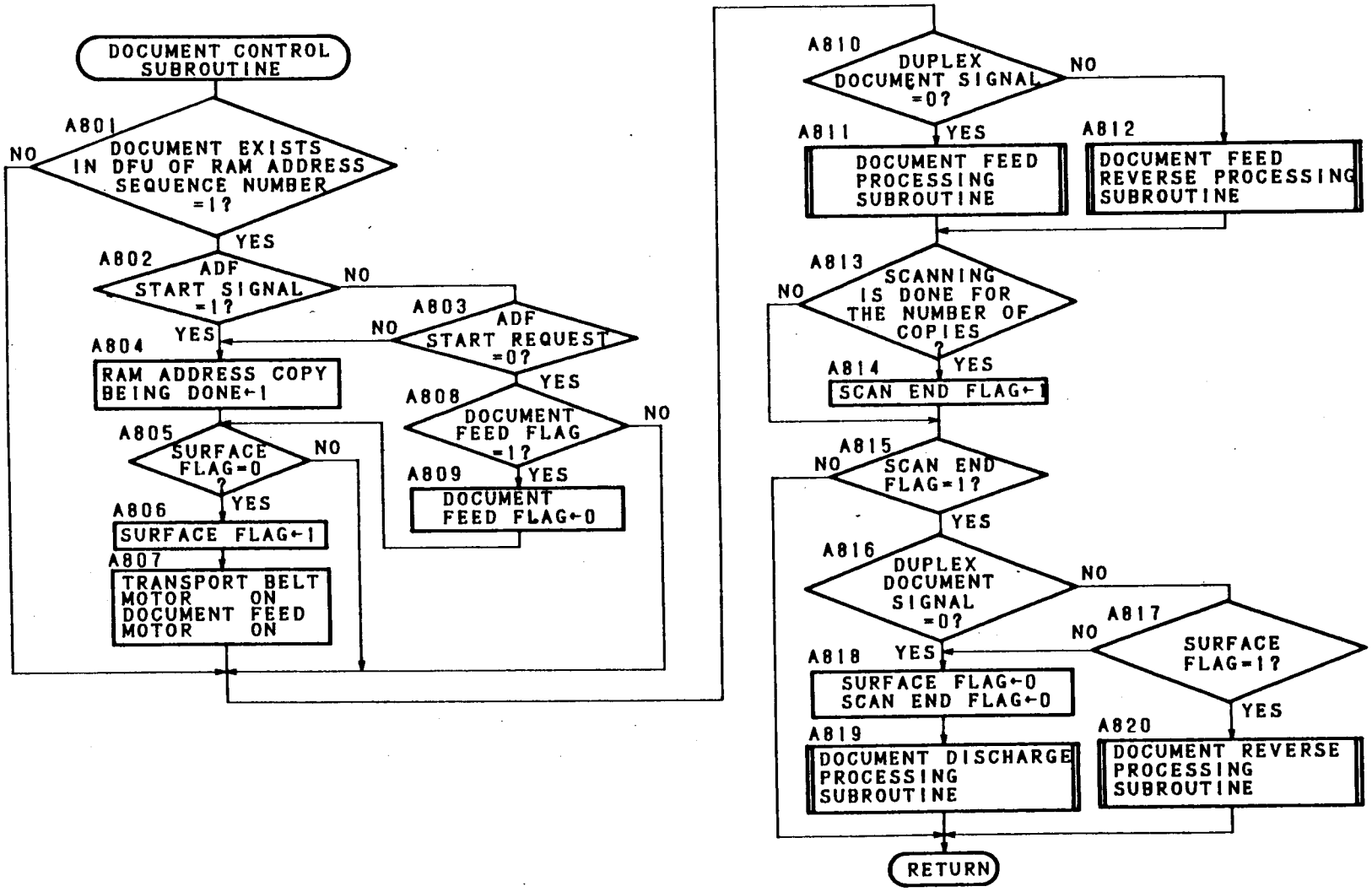

FIG. 22 shows a document control routine in Step A8. In this routine, processings related to feeding and discharging a document are performed. First, the CPU3 detects by the corresponding sensor on the operation panels 461 to 463, whether or not a document exists in the DFU whose RAM address "sequence number" is 1.

If the document exists, the CPU3 sets "under copying" of the RAM address of the DFU whose RAM address sequence number is "1" to "1" (Steps A801 to A804) and judges a surface flag, when the ADF start signal from the CPU1 is "1" or the ADF start request is "1", namely, when any of the document discharge tray is empty and the ADF 300 can be started. When it is the mode to copy the surface of a document, the CPU3 sets the surface flag to "1" and turns on the transport belt motor 306 and the document feed motor of the corresponding DFU (Steps A805 to A807). When the ADF start signal is "0" and the ADF start request is also "0" Step A802, the CPU3 judges the document feed flag or a flag controlling start of feeding the documents of the second sheet onward. When the document flag is "1", the CPU3 resets this flag and turns ON the two motors aforementioned (Steps A803, A808, A809).

The document is then fed by the aforesaid processings and the CPU3 determines the both sides document signal from the CPU1 in Step A810, when the signal is "0", or in the case of one side copying, calls the document feed processing routine (Step A811). If the signal is "1" or in the case of two sides copying, the CPU3 calls the document feed reverse processing routine (Step A812).

Figure 23:
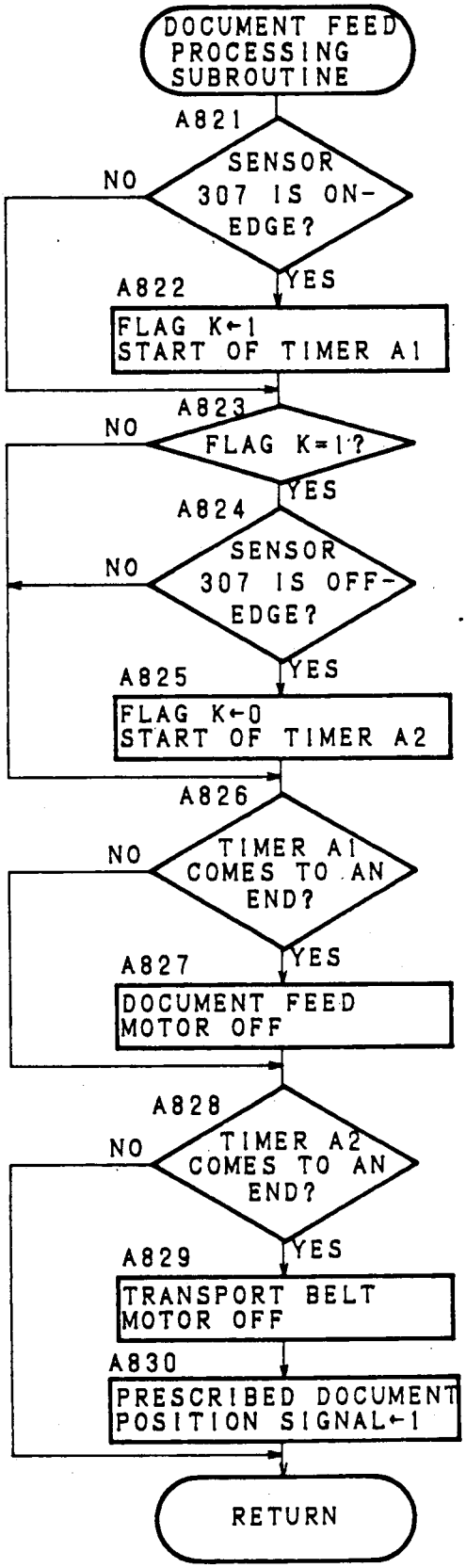

FIG. 23 shows the document feed processing routine. First, when a document is fed, a sensor 307 provided at the end portion on the side of DFU 401 of the document transport control portion 301 detects it, and the CPU3 sets a flag K to "1" by its ON-EDGE and starts a timer A1 (Steps A821, A822). The timer A1 is provided to turn OFF the document feed motor or to retain the next document such that it is not sent before a predetermined processing is completed, and in which the time to reach the position where the document is driven by the transport belt 305 is set. Then, the CPU3 judged the flag K, if the flag is "1", it detects OFF-EDGE of the sensor 307 or the trailing edge of the document to reset the flag K and starts the timer A2 (Steps A823 to A825). In the timer A2, the time for the trailing edge of the document to reach a predetermined edge position of the document on the document table 35 is set. Then, the CPU3 turns OFF the document feed motor and transport belt motor 306 respectively at time-up of the timers A1 and A2, and sends the signal indicating that the document is set in a predetermined position to the CPU1 (Steps A826 to A830).

Figure 24:
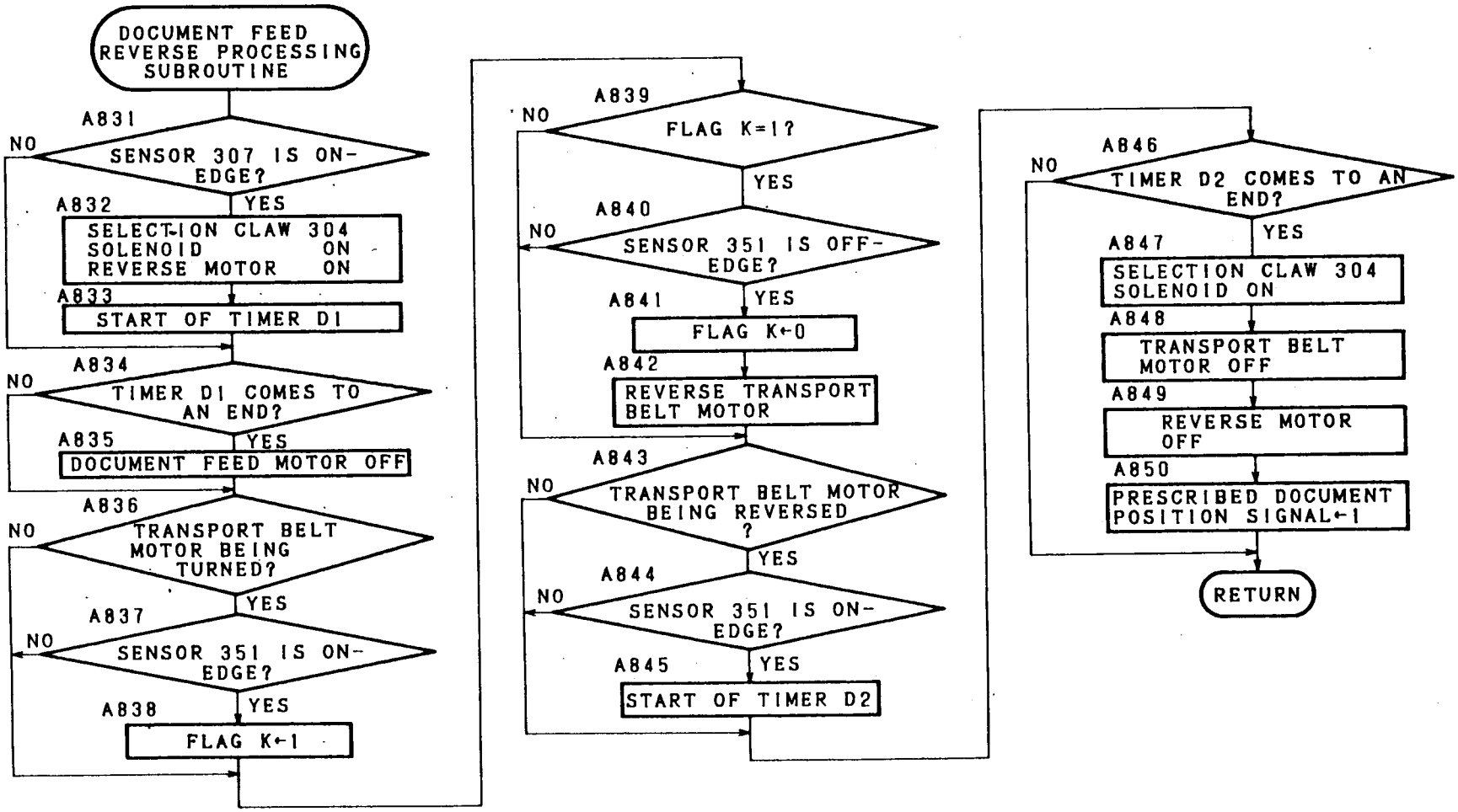

FIG. 24 shows the document feed reverse processing routine in Step A812 aforementioned. First, a document is fed and the CPU3 turns ON the solenoid of the selection claw 304 provided at the end portion of the side of R unit 350 of the document transport control portion 301, and the reversing motor 352 of the R unit 350 respectively by ON-EDGE of the sensor 307 and starts a timer D1 (Steps A831 to A833). That is, the selection claw 304 is switched so as to send a document toward the R unit 350 and to bring the R unit 350 in an operating state. A timer D1 is provided exactly for the same purpose as the timer A1, and the CPU3 turns OFF the document feed motor at time-up of the timer D1 (Steps A834, A835).

Then, when the transport belt motor 306 is rotated in the normal direction and ON-EDGE of the document detecting sensor 351 of the R unit 350 is detected, namely, the front edge of the document enters into the R unit 350, the CPU3 sets the flag K (Steps A836 to A838). When OFF-EDGE of the document detecting sensor 351 is detected or the document enters entirely to the rear edge into the R unit 350 by setting of the flag K, the CPU3 resets the flag K and reverses the transport belt motor 306 (Steps A839 to A842).

Then, when ON-EDGE of the document detecting sensor 351 is detected again during reverse rotation of the transport belt motor 306, or when the reversed document starts to come out from the R unit 350, the CPU3 starts a timer D2 (Steps A843 to A845). In the timer D2, the time for the reversed document to reach a predetermined copying position on the document table 35 by the transport belt 305 being rotated reversely after detected by the document detecting sensor 351 is set.

Then, at time-up of the timer D2, the CPU3 turns OFF entirely the solenoid of the selection claw 304, transport belt motor 306 and reversing motor 352, and sends the document fixed position signal to the CPU1 (Steps A846 to A850).

As described hereinabove, in the present routine in which both sides of the document are copied, the document is adapted to be reversed so as to be copied first from the rear side.

This is because that, by copying the surface side later, the document is not discharged upside down into the discharge tray of the sorter or the like.

Now, the CPU3 judges whether or not a document is set at a fixed position and scanning of a predetermined number of copies is completed by the document feed processing routine in Step A811 or the document feed reverse processing routine in Step A812 decribed hereinabove in conjunction with FIG. 22, if completed, the CPU3 sets the scan end flag (Step A813, A814).

When both sides of a document have to be copied, first, one side or the rear side is scanned by a prescribed number of sheets in Step A812, and paper to be copied onto which only the rear side of the document is copied are stocked in the main body of the present apparatus 1 so as to be fed again when copying the surface side to be described later.

Then, the CPU3 determines the two-side document signal in Step A816, and if the signal is "0" or the document is one-side, resetting the surface flag and scan end flag respectively and calls the document discharge processing routine (Steps A818, A819).

When the two-side document signal is "1" and the surface flag is "1", or when only the rear side of the two-side document has been copied, the CPU3 calls the document reverse processing routine (Steps A816, A817, A820).

Figure 25:
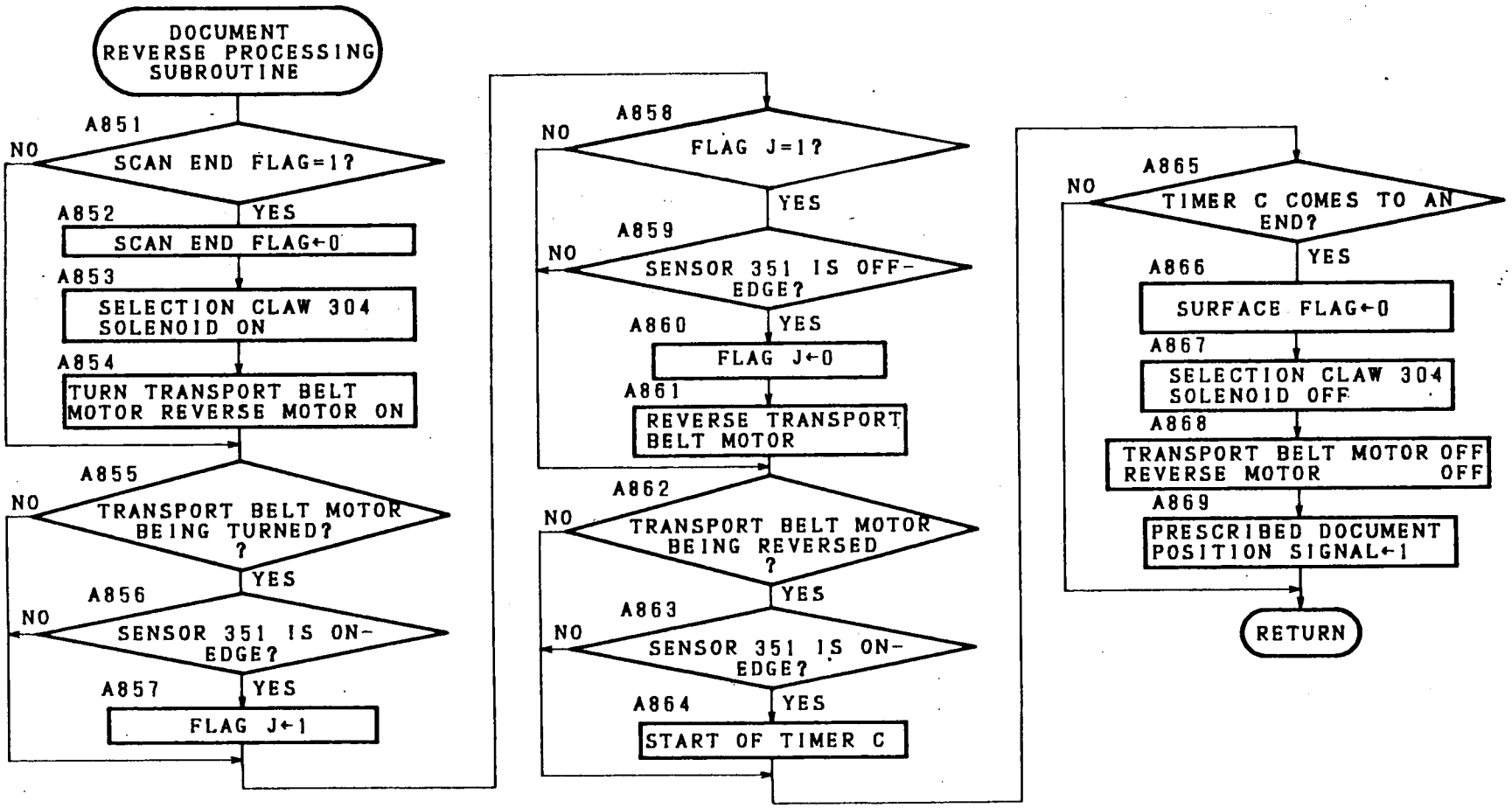

FIG. 25 shows the document reverse processing routine in Step A820. When the scan end flag becomes "1", the CPU3 resets the flag (Steps A851, A852). Then, the CPU3 excites the solenoid of the selection claw 304, rotating the transport belt motor 306 normally and turns ON the reversing motor 352 of the R unit 350 (Steps A853, A854). Thereby, a document is introduced into the R unit 350. Thereafter, the processing is substantially as same as the document feed reverse processing routine in aforesaid Step A812, whereby the two-side document whose rear side has been copied and positioned with the surface side up is reversed by the R unit 350, and discharged on the document table 35 with the rear side up so as to be set at a document fixed position at time-up of a timer C, then the CPU3 resets a surface flag (Steps A855 to A869).

Thereby, the surface side of the two-side document is copied, then, as Step A817 in FIG. 22 is "0", the CPU3 resets a scan end flag in the same way as the case of one-side document, and calls the document discharge processing routine in Step A819.

Figure 26:
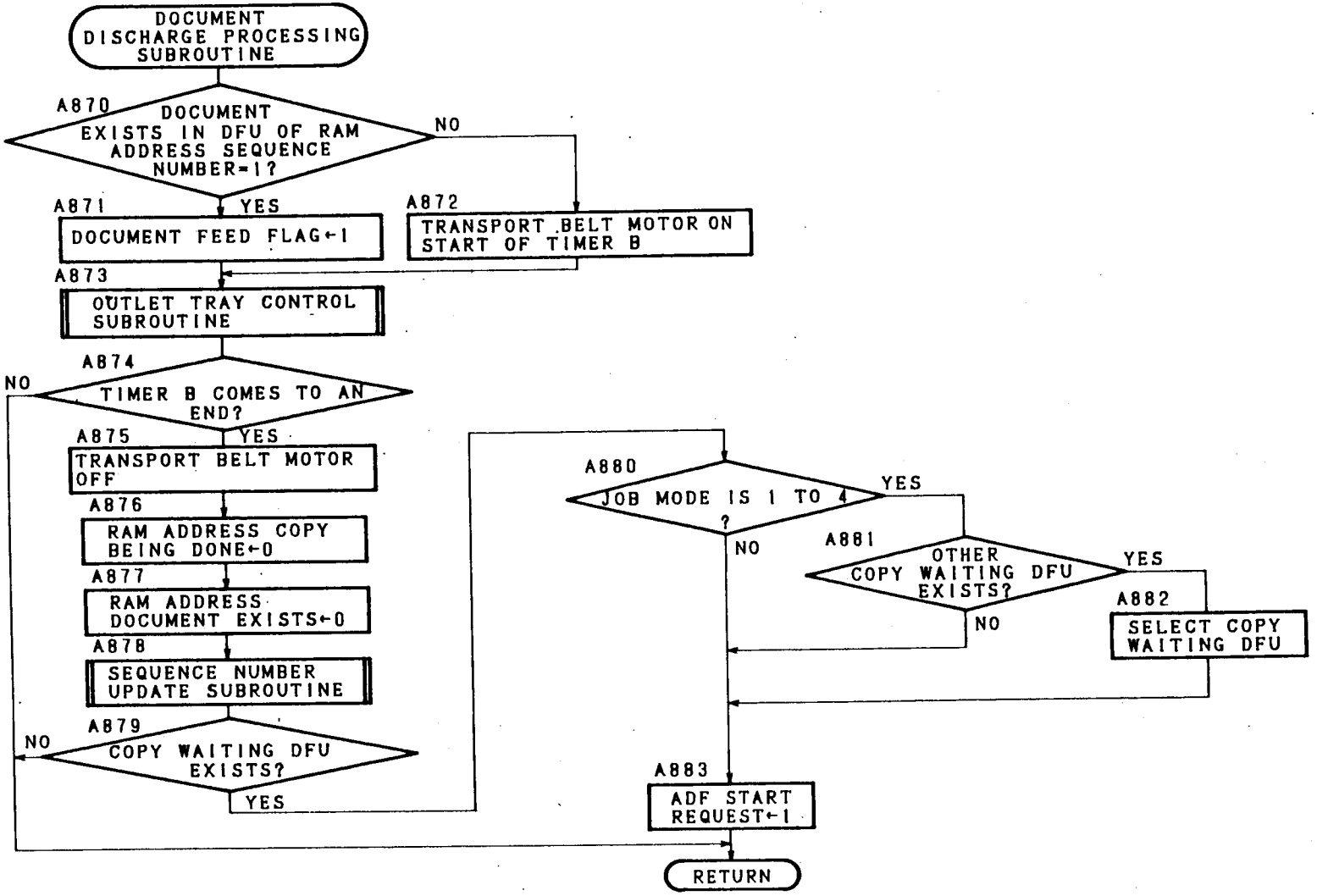

FIG. 26 shows the document discharge processing routine. First, the CPU3 determines whether or not a document remains in the DFU whose sequence number is 1, if the document exists, it sets the document feed flag to "1". If no document exists, the transport belt motor 306 is turned ON to start a timer B (Steps A870 to A872). The timer B serves to control the transport belt motor 306 for sending the document to the discharge portion. In place of the timer B, a discharge sensor 308 may be used. Then, the CPU3 calls the discharge tray control routine shown in FIG. 27 (Step A873). In this routine, the CPU3 controls a paper passage 506 of the discharged document so that the document is discharged to a preselected DDU. When the document feed flag becomes "1", the document is fed and the transport belt motor 306 is turned ON. Thus, a new document and copied document are transported simultaneously by the transport belt 305, and the latter is processed by the discharge tray control routine.

Figure 27:
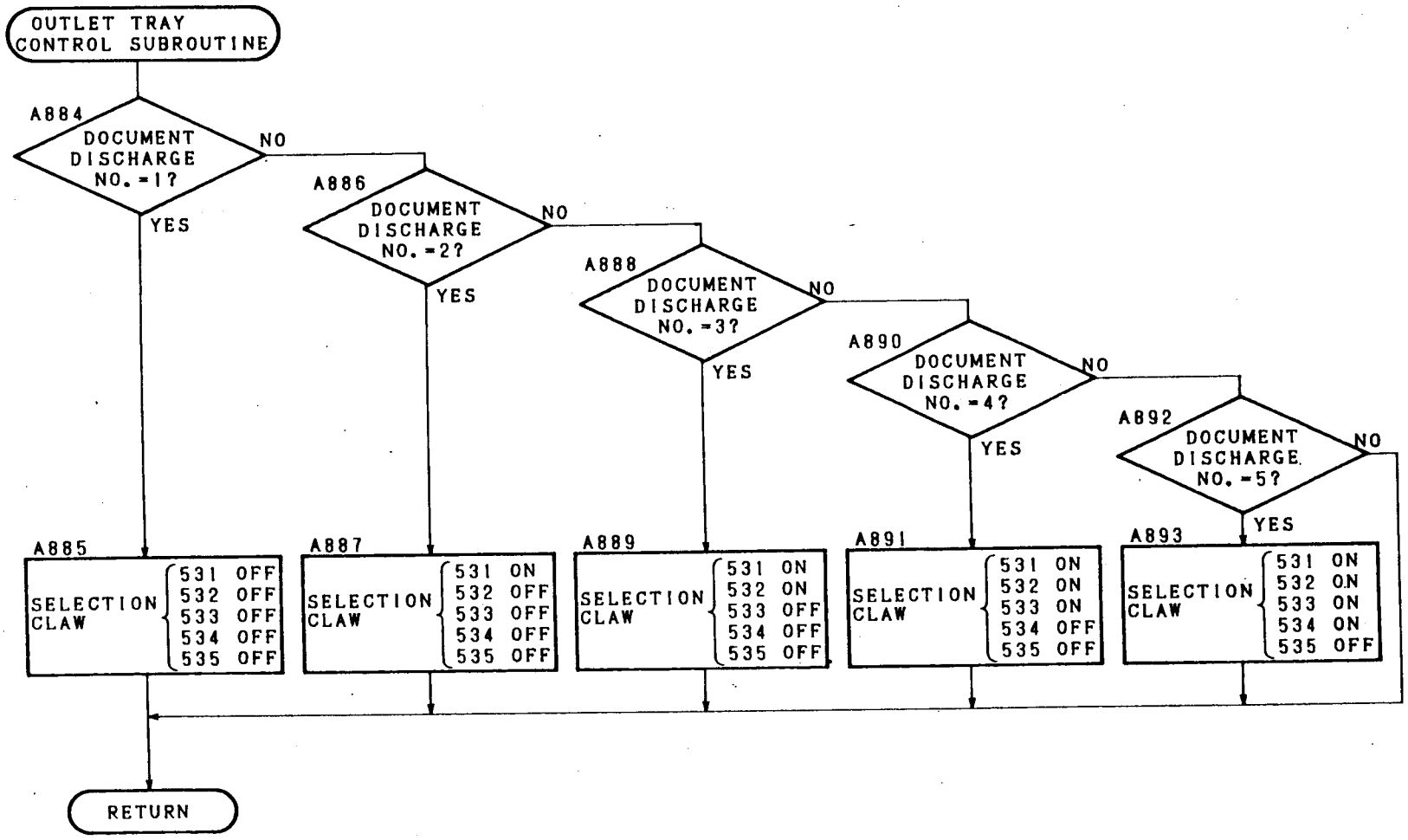

As shown in FIG. 27, the discharge tray control routine controls to turn ON and OFF the electromagnetic solenoid for operating the document discharge passage selection claws 531 to 535 shown in FIG. 1, in response to the preset number in the discharge unit number area of the RAM map shown in FIG. 9. For example, if the document which is being fed is discharged to the unit number "5" (Step A892), the CPU3 turns ON the selection claws 531 to 534 and turns OFF the selection claw 535 (Step A893). Thereby, the document passes smoothly through the transport passage 506 from the bottom to the top and when the document contacts the selection claw 535, it is discharged into the tray 515.

Figure 28:
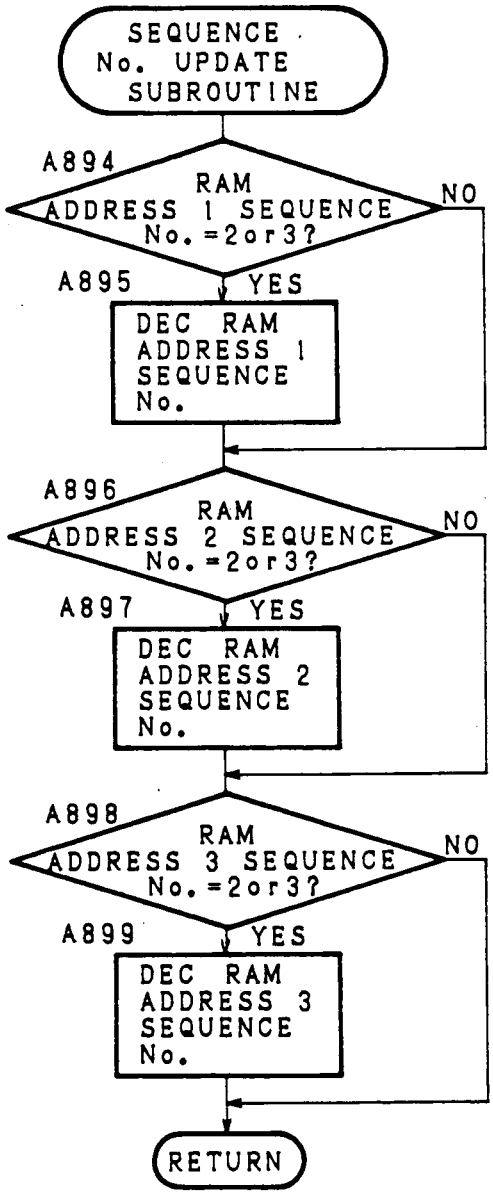

Now, for the last exposed document, the CPU3 turns OFF the transport belt motor 306 at time-up of the timer B in Step A874 in FIG. 26, bringing the RAM address "copy being done" of the DFU whose "sequence number" is 1 to "0" and sets the "document existence" to "0" (Steps A875 to A877). Then, the CPU3 calls the sequence number update routine in Step A878. In this routine, as shown in FIG. 28, the content of the sequence number area of the RAM address is judged when the copying processing for all the documents set in one DFU is completed, and the copying order is moved up by one.

In the present embodiment, the DFU is constructed by connecting three DFUs and judge of the sequence number is made by discriminating between 2 and 3. If the sequence number is 2, it is moved up to 1, and if it is 3, it is moved up to 2 (Steps A894 to A899). When a new document is set in the DFU which is just completed, a sequence number 3 is set for the new document by a mode memory routine in FIG. 18.

When processing of the sequence number update routine is completed, the CPU3 judges in Step A879 whether or not there are any DFU waiting for copying. If such a DFU exists, the CPU3 judges whether or not the job mode of this DFU is set to any of 1 to 4 (Step A880). That is, when processing of one DFU is completed and the processing of a DFU set to the next sequence number is started, the CPU3 judges registration of the job mode of the DFU, and if it is not registered, sets the ADF start request to "1" in accordance with the sequence number to start processing (Step A883). However, when any of the modes of jobs 1 to 4 is registered in the DFU, the CPU3 judges whether or not there is the other DFU waiting for copying (Step A881), if such a DFU exists, which is selected with priority to start processing (Step A882).

When the other DFU waiting for copying does not exist in Step A881, or when the empty time occurs in the multijob of the present apparatus, processing for the DFU in which the job mode is registered is started. The DFU in which the job mode is registered and for which the processing is started in this manner is subjected to the predetermined processing by the job control routine of FIG. 16 as aforementioned.

Figure 29:
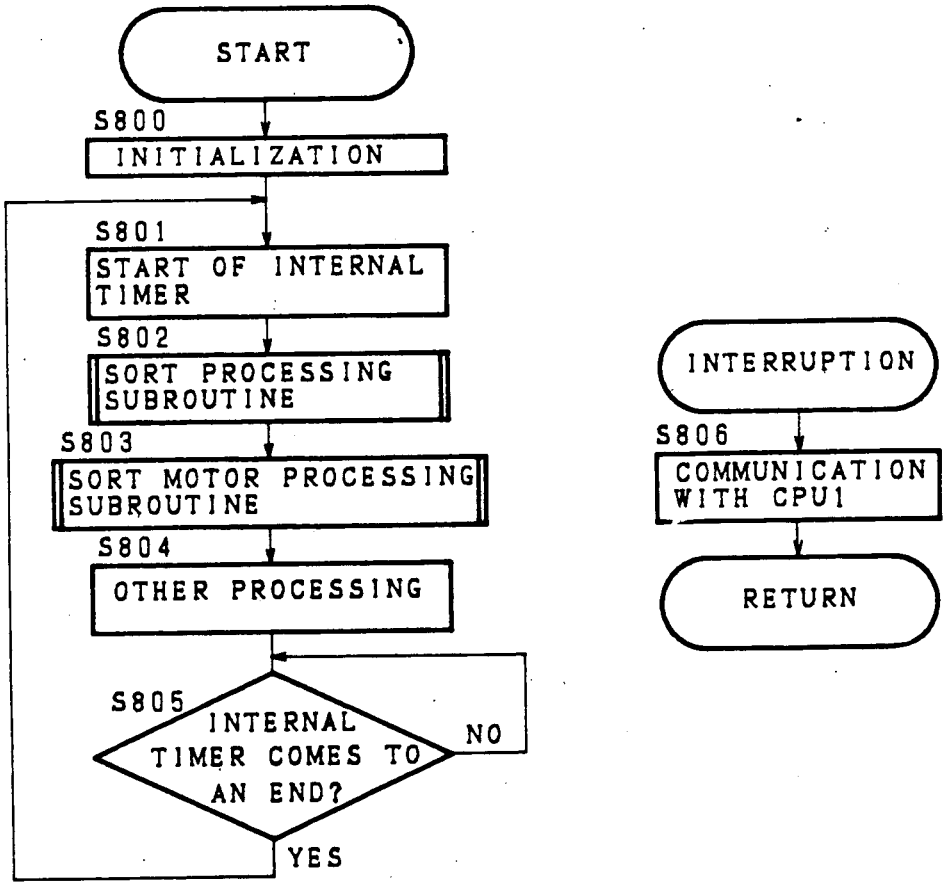

Now, control operation of the sorter will be explained. FIG. 29 shows a general flow chart of a program in a CPU4 (280) for controlling the first and second sorters 600, 650. When the program starts, the CPU4 makes initialization in Step S800 to clear an incorporated RAM and to set the contents of various registers. Then, the CPU4 starts an internal timer, calling successively the subroutine for sorter processing in Step S802 and the subroutine for sorter motor processing in Step S803, and judges completion of the internal timer in the final Step S805. When the internal time is completed, the CPU4 starts the timer again (Step S801) and repeats the loop to use the time for one routine of the loop in a clock of a software timer in the same way as the other CPUs. When the interrupt request is made from the CPU1, the CPU4 makes communication therewith in Step S806.

Figure 30A:
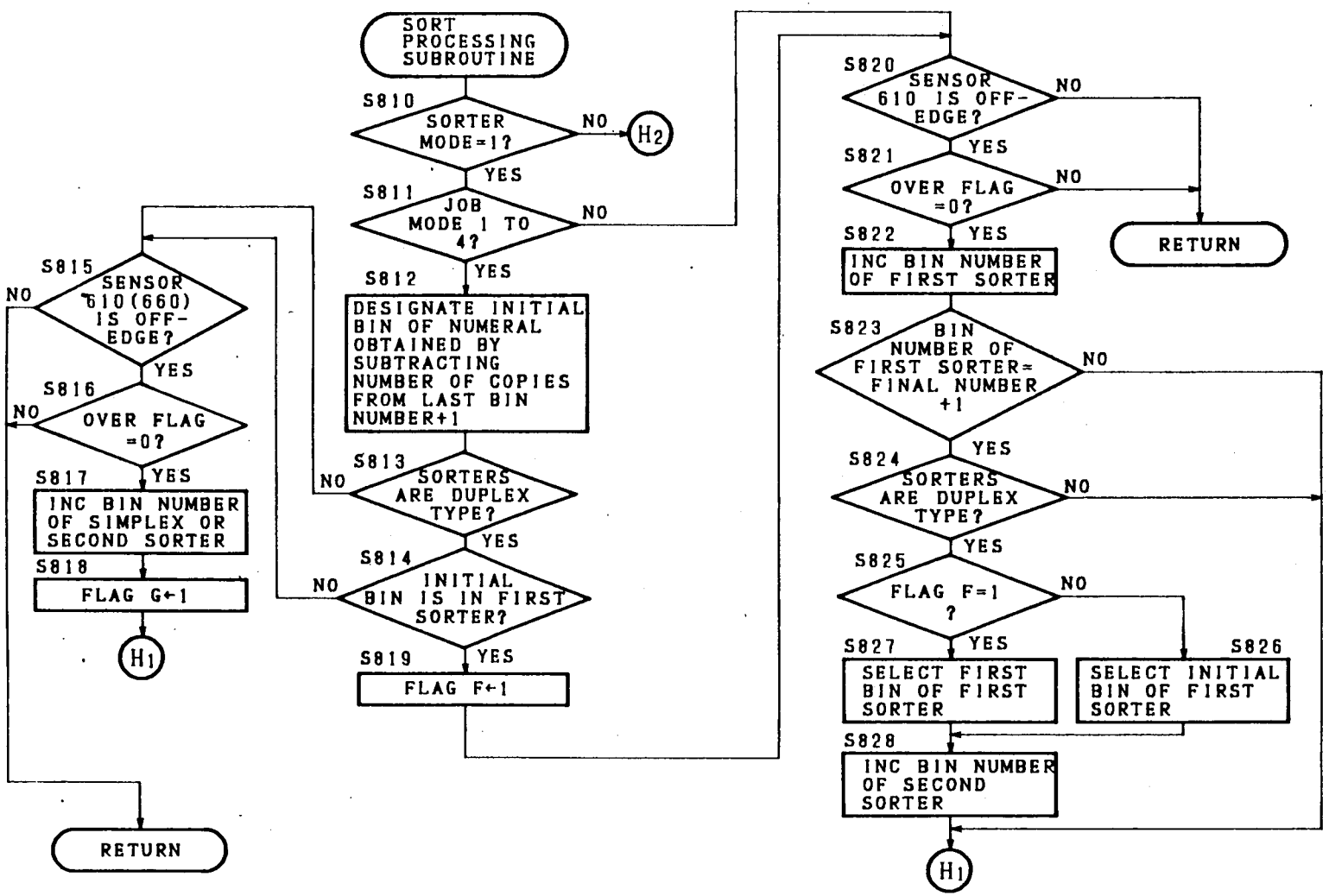
Figure 30B:
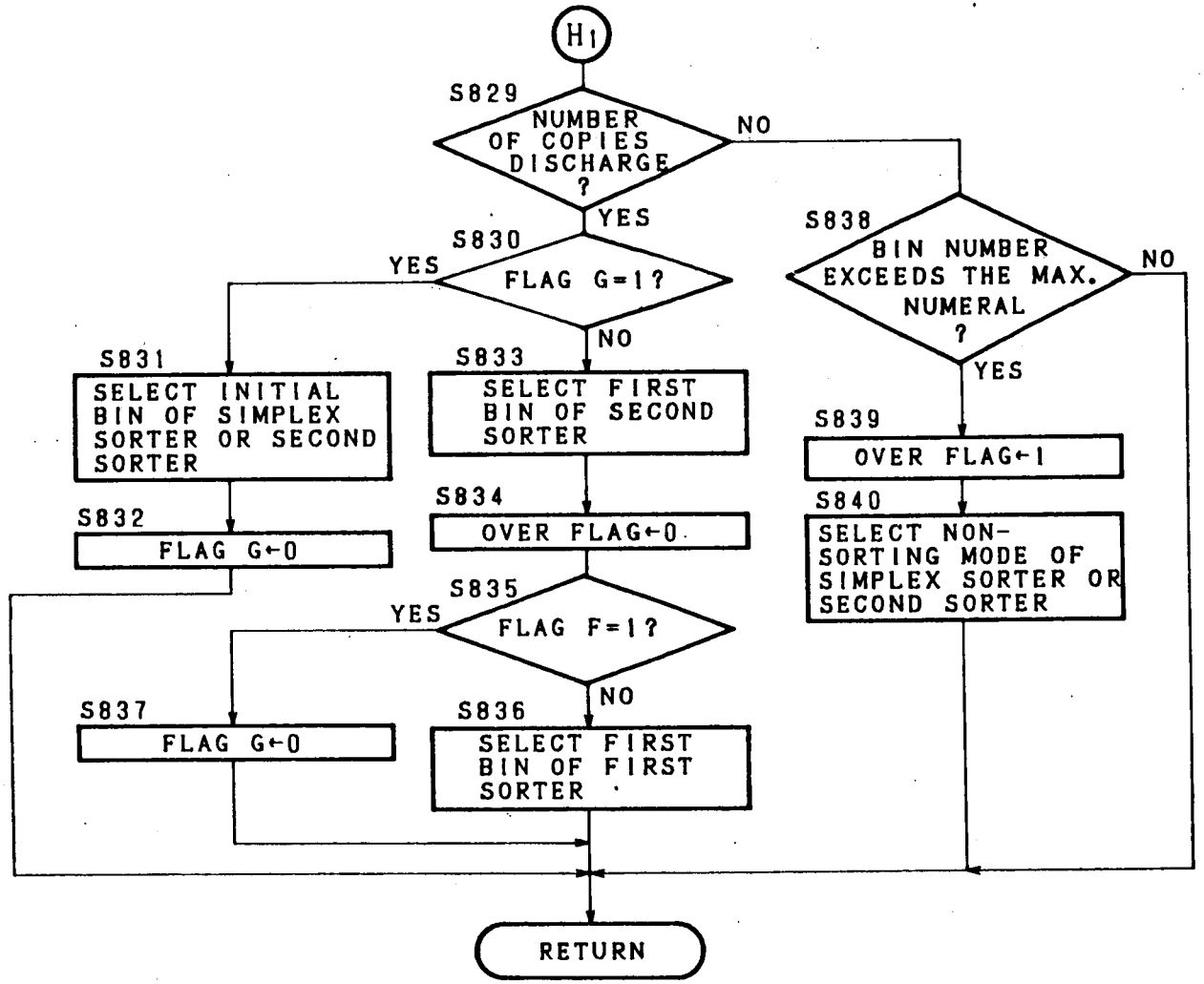
Figure 31:
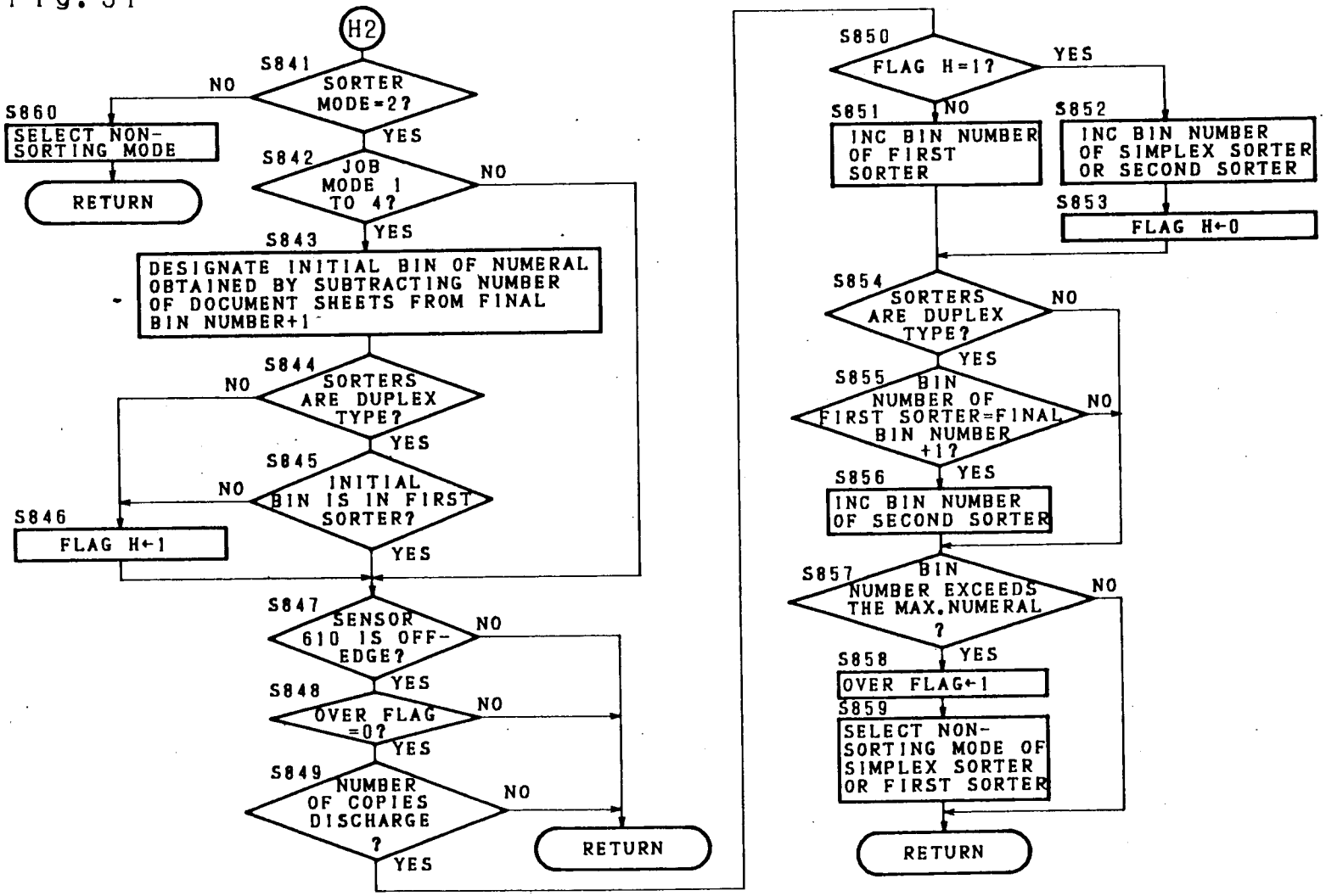

FIGS. 30, 31 show the sorting processing routine in Step S802. When the "sorter mode" of the RAM address of the selected document feed unit is 1 in Step S810 or it is in the sorting mode, then, the CPU4 judges whether or not the "job mode" is set to any of 1 to 4 (Step S811). If it is set, in Step S812, the CPU4 designates a bin of a numeral obtained by subtracting the number of copies from a last bin number of the sorter plus one as an initial bin or the first bin of a series of bins to be used.

That is, since the number of bins of the job required in the sorting mode is equal to the number of copies, the bins are numbered in order from the last bin number of the maximum available number of bins in the system, or from the top bin of the first sorter 600 in the present embodiment. The initial bin number can be calculated by subtracting the number of document sheets from numeral obtained by adding one to the number given to the bottom bin of the second sorter 650. A series of bins from the initial bin to the last bin of the bottom stage of the second sorter 650 designated in this manner are allocated for the job. However, when the number of copies exceeds the number of bins available, the initial bin is numbered one or becomes the first bin.

When the initial bin is designated, then the CPU4 judges whether or not the sorters are a duplex type as shown in the present embodiment (Step S813). When it is the duplex type, the CPU4 judges whether or not the initial bin is in the first sorter 600, and if it is in the first sorter 600, sets the flag F to "1" and proceeds to Step S820. The CPU4 also proceeds to Step S820 when the job mode is not set in the aforesaid Step S811, or when use state of the sorter is normal.

While, when the sorter is not the duplex type but a simplex type, or when the initial bin is in the second sorter 650, the CPU4 proceeds to Step S815 in both cases. That is, when the sorter is used normally and the job mode is set and the initial bin is designated in the first sorter 600, the CPU4 proceeds to Step S820. When the job mode is set and the initial bin is designated in the second sorter 650 or the sorter is the simplex type, the CPU4 proceeds to Step S815. Then, in Steps S820, S821 or in Steps S815, S816, the CPU4 detects OFF-EDGE of a sensor 610 (660), namely, transport of the copied paper from the sorting passage 615 (665) to the first bin (set initially at normal use) or to the designated initial bin. When the over flag indicating whether or not the number of copies exceeds the number of bins is 0, the CPU4 increments the bin number of the first sorter for the former case (Step S822). For the latter case, the CPU4 increments the bin number of the simplex sorter or the second sorter, setting the flag G to "1" (Steps S817, S818) and sorts copied paper to respective bins. When the bin number of the first sorter becomes the final bin number of the first sorter plus one (Step S823) in the former case, namely, when the copied paper exceeds all the available bins of the first sorter before being discharged by the number of copies at normal use, or the copied paper are contained in all the bins from the initial bin designated by setting the job to the final bin of the first sorter, and in the case the second sorter is used next, the CPU4 judges in the following Steps S824, S825 whether or not the sorters are duplex type, or the flag F aforementioned is set. When the second sorter is used next by setting the job mode, the CPU4 judges in Step S813 that the sorters are duplex type and selects the initial bin of the first sorter 600 in Step S827, since the flag F is set in Step S819, namely, the CPU4 returns the bin number to the initial bin for copied paper of the second document sheet, and increments the bin number of the second sorter 650 (Step S828). When, at normal use, the sorters are the duplex type, the CPU4 similarly selects the first bin of the first sorter (Step S826) and increments the bin number of the second sorter 650. When the sorters are not the duplex type at normal use, the CPU4 judges in Step S838 that the bin number exceeds the maximum numeral or all the available bins of the simplex sorter. Then, the CPU4 sets the over flag, selecting the non-sorting mode of the simplex sorter (Steps S839, S840) and discharges the extra copied paper to the non-sorting tray. This non-sorting mode is selected similarly when the final bin number of the second sorter 650 is exceeded in the duplex type, and in this case, the first sorter 600 performs sorting.

When the copied paper for the first document sheet are discharged by the number of copies (Step S829), the CPU4 then judges the flag G (Step S830). When the flag G is set, or when sorting from the initial bin designated in the simplex sorter or the second sorter to respective final bins is completed, the CPU4 again selects the designated initial bin in Step S831, resetting the flag G to "0" (Step S832) and similarly sorts the copied paper for the second document sheet.

While, when the flag G is not set, namely, at normal use or when sorting from the initial bin designated in the first sorter 600 to the final bin of the second sorter 650 is completed, the CPU4 selects the first bin of the second sorter 650, resetting the over flag (Steps S833, S834) and judges a flag F in next Step S835. Since the flag F is not set at normal use, the CPU4 selects the first bin of the first sorter 600 (Step S836). When the flag F is set, the CPU4 resets the flag F (Step S837) and similarly sorts the copied paper for the second document sheet.

Now, in Step S810, when "sorter mode" is not 1 but 2, or when the grouping mode is set, in the same way as the sorting mode shown in FIG. 31, the CPU4 performs different processing according to whether the "job mode" is set to any of 1 to 4, or not set and in the ordinary sorter using state. First, if the job mode is set, the CPU4 designates similarly the bin of numeral obtained by subtracting the number of document sheets from the final bin number of the sorter plus 1 as the initial bin in Step S843.

That is, the number of bins of the job used in the grouping mode is equal to the number of document sheets, and a series of bins from the initial bin to the final bin designated in this manner are allocated for the job.

Then, CPU4 judges whether or not the sorter is the duplex type. When the sorter is simplex type or the initial bin is designated in the second sorter of the duplex type, the CPU4 sets a flag H to "1" (Step S844 through S846). Then, in the same way as the normal use, the CPU4 detects OFF-EDGE of the sensor 610, judging the over flag and discharges the copied paper by a predetermined number of copies into the initial bin. When this is completed, the CPU4 increments the bin number of the simple sorter or the second sorter by the flag H which has been set, resetting the flag H and allocates the copied paper in group to respective bins till the final bin (Steps S847 to S853).

While, at normal use or when the initial bin is designated in the first sorter, the CPU4 increments the bin number of the first sorter in Step S851 and allocates copied paper to respective bins in group in the same way as aforementioned. When shifted to bins of the second sorter in the duplex type, the CPU4 judges it in Steps S854, S855 and increments the bin number of the second sorter (Step S856). When the bin number exceeds the maximum numeral in the system or the final bin at normal use, the CPU4 sets the over flag, and selects the non-sorting mode for itself if the sorter is simplex and for the first sorter if duplex (Steps S857 through S859).

If the "sorter mode" is also not 2 or when it is 1 in the aforesaid Step S841, the CPU4 selects the non-sorting mode in Step S860.

Figure 32:
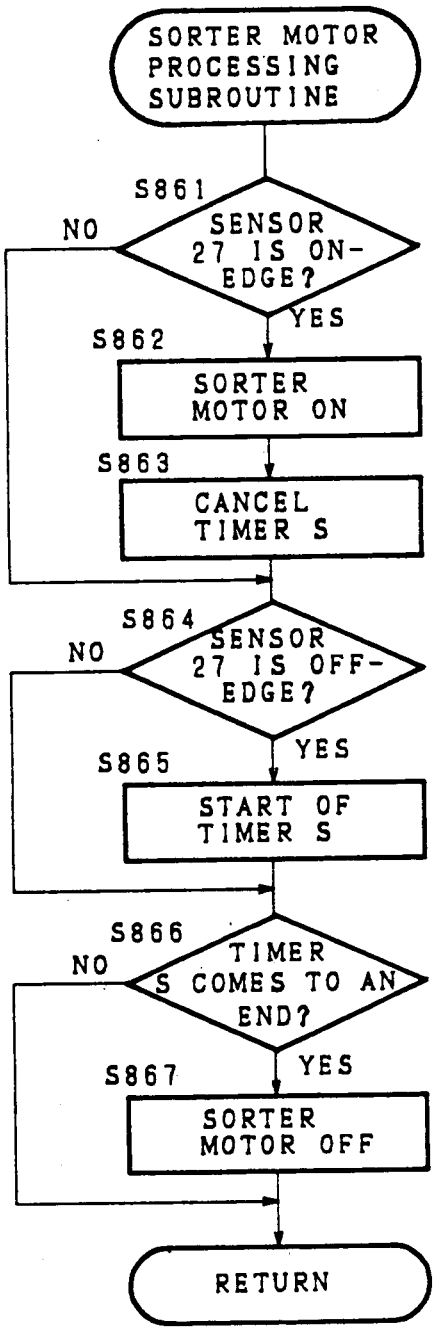

FIG. 32 shows a sorter motor processing routine in Step S803. First, when the front edge of the copied paper to be discharged is detected at the paper outlet 26 of the main body of the present apparatus 1 by ON-EDGE of the sensor 27 (Step S861), the CPU4 turns ON the sorter motor 601 or both the 601 and 651 and then cancels a timer S (Steps S862, S863). Then, if the rear edge of the copied paper is detected by OFF-EDGE of the sensor 27, the CPU4 starts the timer S (Steps S864, S865).

In the timer S, the time for the copied paper to be transported in the passage in the sorter and distributed to respective bins is preset, and the CPU4 turns OFF the sorter motor at time-up of the timer S (Steps S866, S867).

In brief, the DFU in which any of the job modes 1 to 4 is set starts copying operation of the document set therein, when copying operations of the documents in all the other DFU has been completed and the empty time has occurred. Then, according to the preset number of document sheets and copies and the processing mode of the sorter, the number of bins necessary for the copied paper is allocated from the final bin of the sorter so as to contain the copied paper therein. That is, copied paper which are not required immediately are contained in a series of bins including the final bin located in the most spaced position from the first bin into which the copied paper is usually contained when using the sorter. If the document is set newly in the other DFU without setting the job mode during copying operation including discharge processing to the sorter or after copying, copied paper for the new document are arranged to be used from the first bin of the sorter and contained as usual.

In the present embodiment, when copying operation is started by setting the job mode, though the copied paper of the document are arranged to be contained in the necessary number of bins allocated from the final bin of the sorter, the present invention is not limited thereto, bins on the way may be used as well. In the present embodiment, though a system comprising three DFUs, five DDUs and two coupled sorters is shown, the numbers of respective units are not limited thereto.

As described heretofore, in the copying apparatus according to the present invention, when multijobs are processed by using a plurality of DFUs and sorters, for specific document groups which do not require copied paper immediately, copying operation of the document in the other DFU is performed with priority, and when all the copying operations are completed and the empty time has occurred in the copying apparatus, copying operation of the DFU in which the specific document groups are set is started. Then, the copied paper onto which the document is copied in this manner are contained in the predetermined bins corresponding to the necessary number of bins of the sorter obtained on the basis of the preset number of document sheets and copies and the processing mode of the sorter, for example, adjacent the final bin having the most inferior frequency of use. Therefore, even when the copied paper are not picked up by the user for a long period of time because they are not required immediately, copied paper for a new document group set during or after the copying operation for the document having inferior priority are used successively from the first bin of the sorter, so that the copied paper left can be taken out simply, thus the sorter can be used smoothly.

Now, another embodiment of the present invention will be described.

In this embodiment, since operations are similar to those in the first embodiment except the configuration of the copying apparatus, job control routine and mode select routine, explanations thereof will be omitted.

Figure 33:
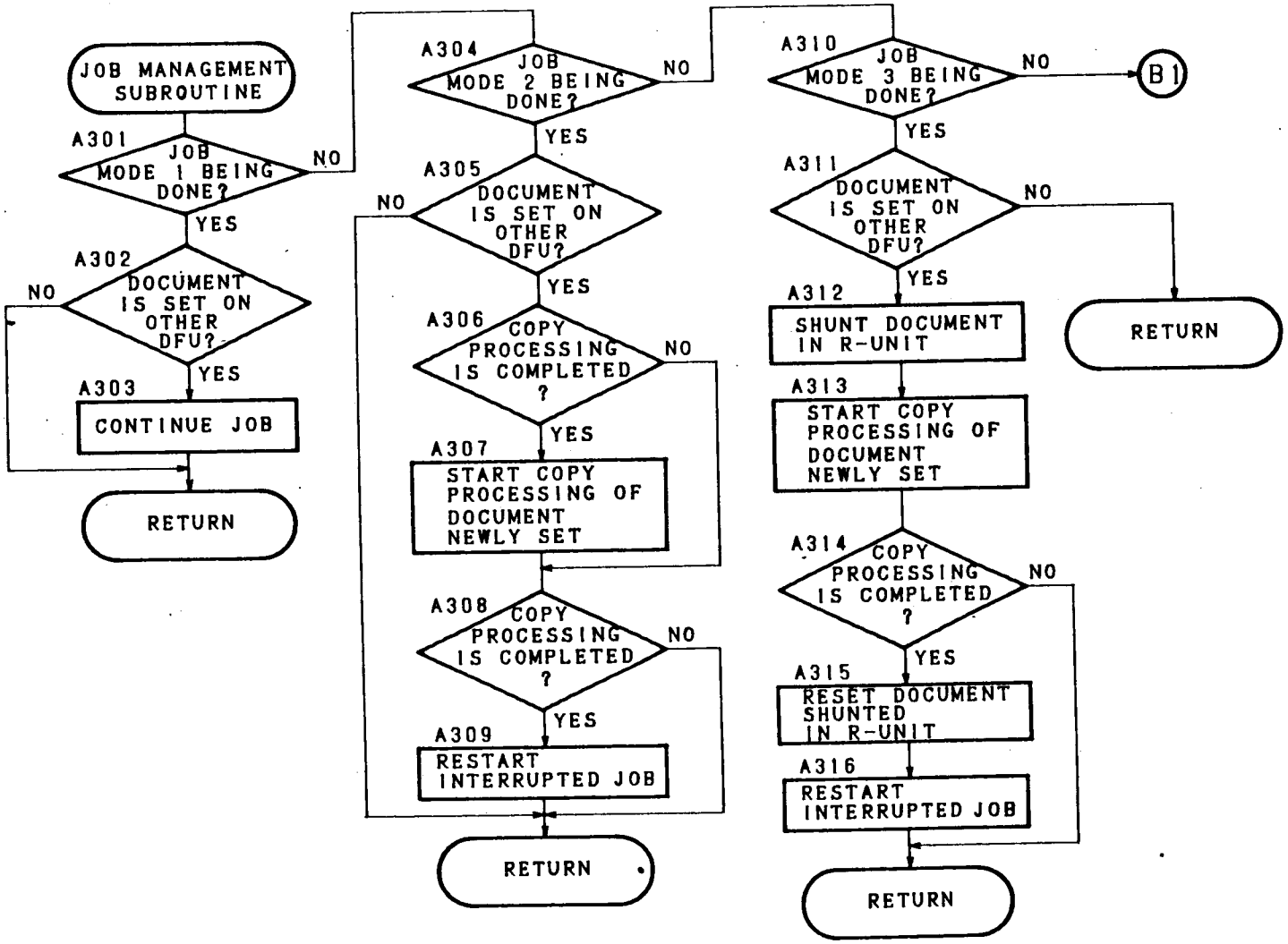
FIGS. 33 through 37 are flow charts showing control procedures of a CPU of a second embodiment of the present invention.
Figure 34:
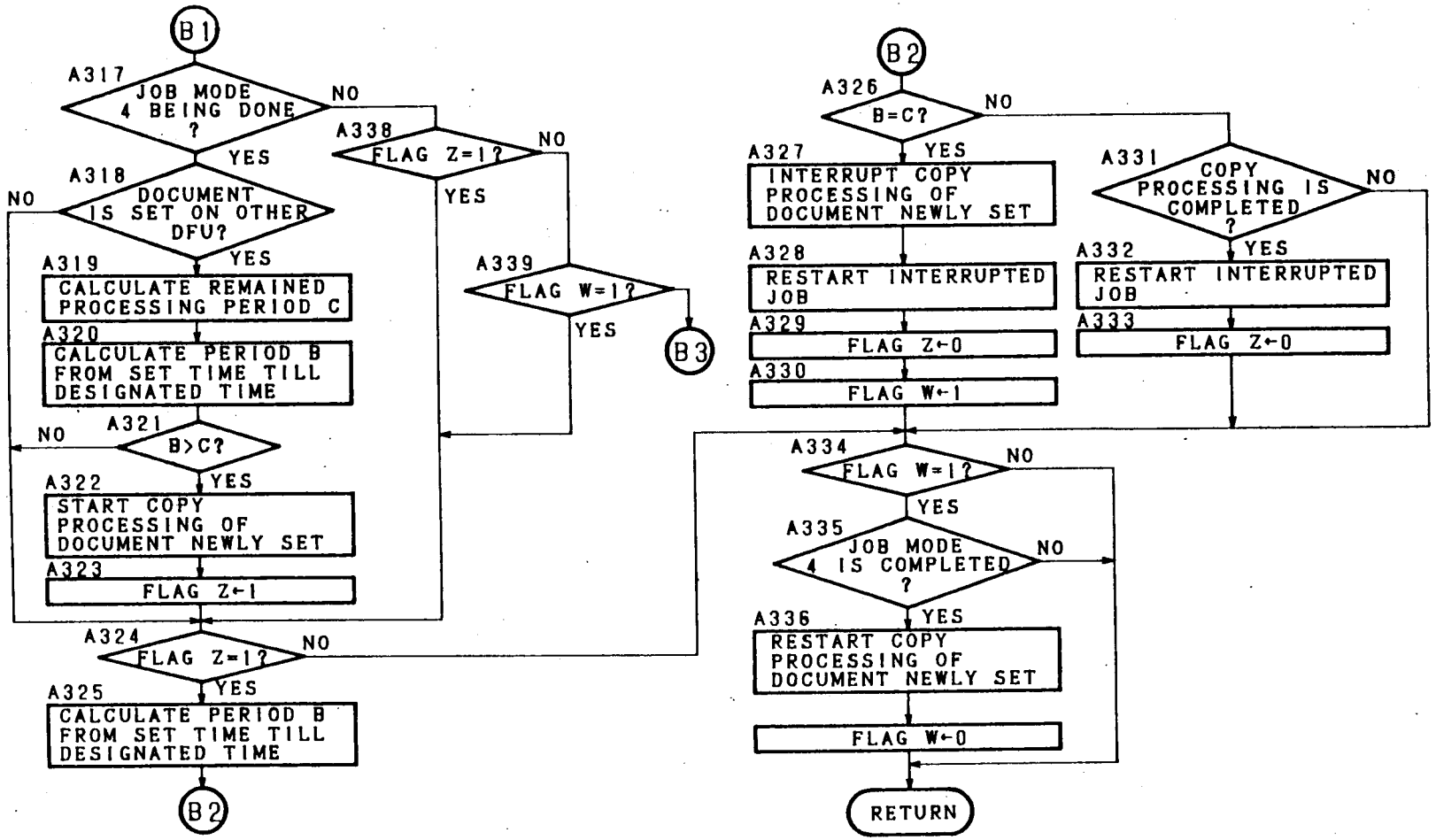
Figure 35:
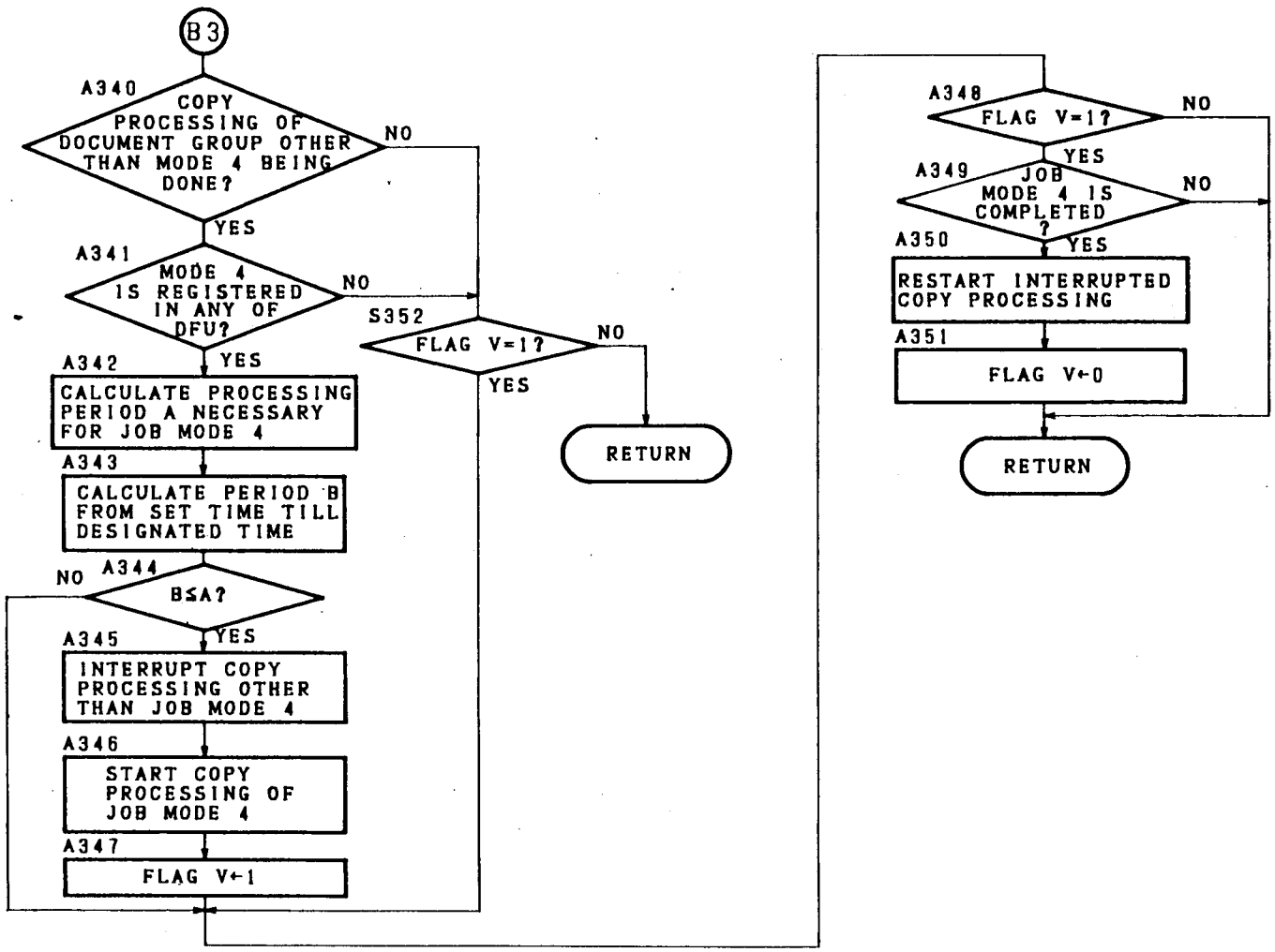

Another embodiment of the job control subroutine in Step A3 of FIG. 15 is shown in FIGS. 33 to 35.

First, in Steps A301, A304, A310, A317, the CPU3 judges whether any of the DFUs is operating in any of the job modes 1 to 4. When documents are set in the other DFU while a certain DFU is executing the job in the job mode 1, the CPU3 continues the job being executed, or completes its own processing neglecting the document newly set (Steps A302, A303).

When the job in the job mode 2 is being executed, the CPU3 judges whether or not copying of a predetermined number of copies for a sheet of document being copied at that point of time is completed. When it is not completed, the CPU3 completes the predetermined number of copies and thereafter interrupts the job in the job mode 2 and starts copying documents newly set in the other DFU, and when the new job is completed, again starts the job which has been interrupted (Steps A304 to A309).

When the job in the job mode 3 is being executed, the CPU3 interrupts the job after completing copying of one copy for a sheet of document being copied at that point of time, and shunts the document in the R unit 350 (Steps A310 to A312).

Then, the CPU3 starts copying documents newly set and when the new job is completed, resets on the document table 35 the document shunted in the R unit 350 and restarts the job which has been interrupted (Steps A313 to A316).

When the job in the job mode 4 is being executed, the CPU3 calculates the remained processing period C at the time when documents are set newly in the other DFU, and the period B from that time till the designated copying completion time (Steps A319, A320). Then, the CPU3 judges in Step A321 whether $B>C$, or the completion time of the job in the job mode 4 being processed at present is before the designated copying completion time. When it is before the designated copying completion time, the CPU3 interrupts the job in the job mode 4 and starts copying documents newly set (Step A322), and sets a flag Z to "1" to indicate that the copying is started (Step A323).

When the flag Z is set, the CPU3 calculates successively the period B from the present time after starting copying for documents newly set till the copying completion time aforementioned (Steps A324, A325). Then, if it becomes $B=C$ in Step A326 or the time from the present time till the copying completion time designated in the job mode 4 becomes equal to the remained time of the interrupted job, the CPU3 interrupts copying operation for documents newly set (Step A327) and restarts the job in the job mode 4 which has been interrupted (Step A328). That is, processing of the job in the job mode 4 restarted in this manner is arranged to be completed at the designated copying completion time.

When the job in the job mode 4 is restarted, the CPU3 resets the flag Z and sets a flag W indicating restart of the job in the job mode 4 (Steps A329, A330). Then, if the job in the job mode 4 is completed in Step A335, the CPU3 restarts the job for documents newly set and interrupted, and resets the flag W (Steps A336, A337).

When, the job for newly set documents are completed in Step A331 before it becomes $B=C$ in Step A326, the CPU3 restarts the job in the job mode 4 which has been interrupted from that time and resets the flag Z (Steps A332, A333). That is, when documents are not newly set in the other DFU thereafter, or the job is completed before it becomes $B=C$ even when the documents are newly set, the job in the job mode 4 is completed before the designated copying completion time.

While, if it is judged in Step A317 that the job in the job mode 4 is not being executed in neither the case where the job is interrupted (Step A338) nor the case where the job is completed after restart of the job (Step A339), the CPU3 proceeds to Step A340. The CPU3 judges here whether or not the job for the document group other than the job mode 4 is performed, and if the job is being processed, it judges whether or not the job mode 4 is registered in any of the DFU (Step A341). When the job mode 4 is registered, the CPU3 calculates the processing period A necessary for the job in the job mode 4 on the basis of the number of document sheets and copies set on the operation panel of the DFU (Step A342).

Then, the CPU3 calculates successively the period B from the present time till the designated copying completion time, and if $B \leqq A$ in Step A344, or if processing for a document group other than the job mode 4 is performed continuously, and processing of the job mode 4 is not started because the empty time does not occur in the copying apparatus, and the present time becomes the time whereat copying operation has to be started to complete the processing of the job mode 4 at the designated copying completion time, the CPU3 interrupts the job other than the job mode 4 being processed at present to start processing of the job mode 4 and sets a flag V (Steps A345 to A347).

When completion of the processing of the job mode 4 is confirmed in Step A349 by setting of the flag V, the CPU3 restarts the interrupted job other than the job mode 4 and resets the flag V (Steps A350, A351). The completion time of processing of the job mode 4 in this case is naturally the copying completion time designated in advance.

Figure 36:
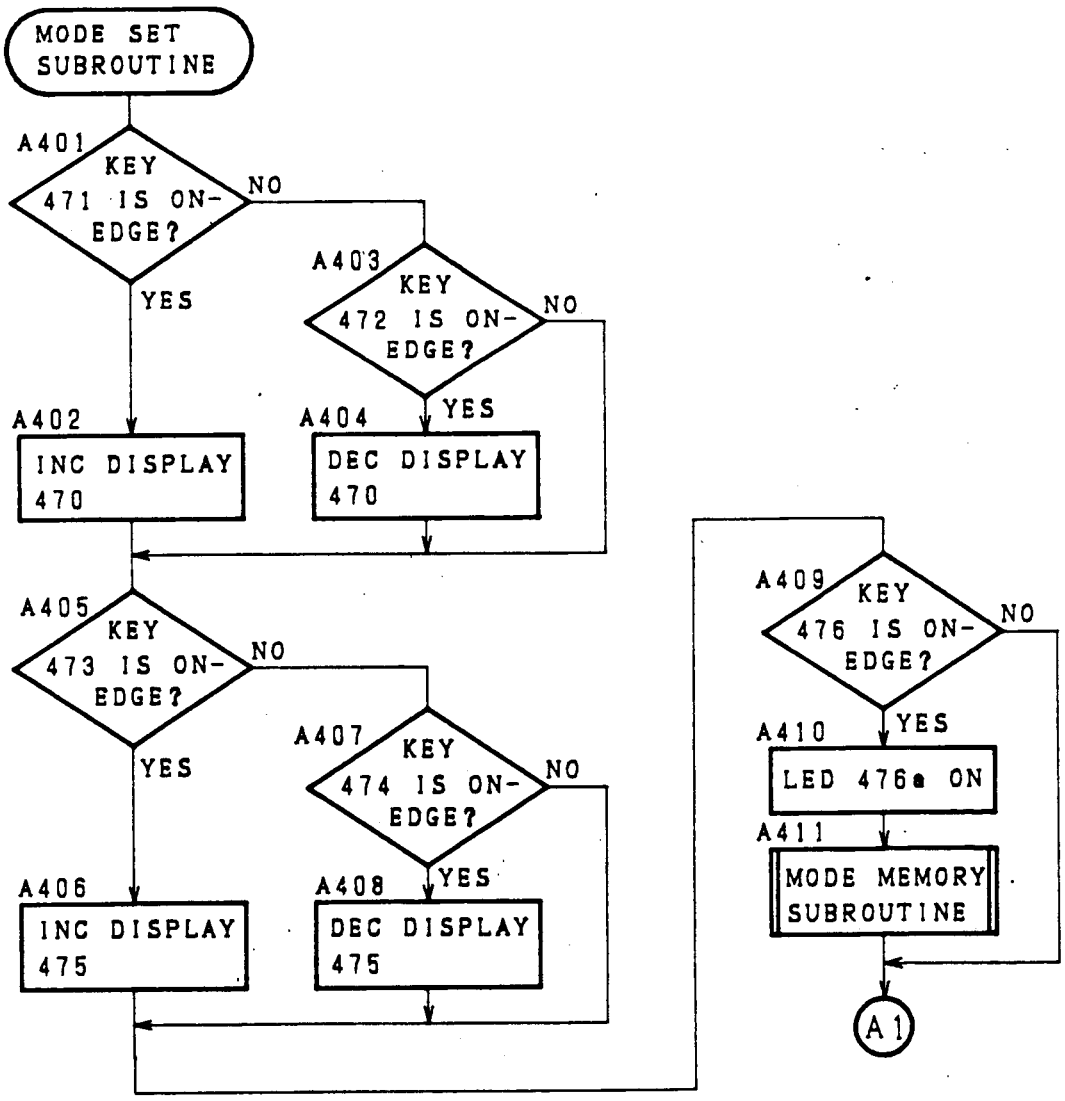
Figure 37:
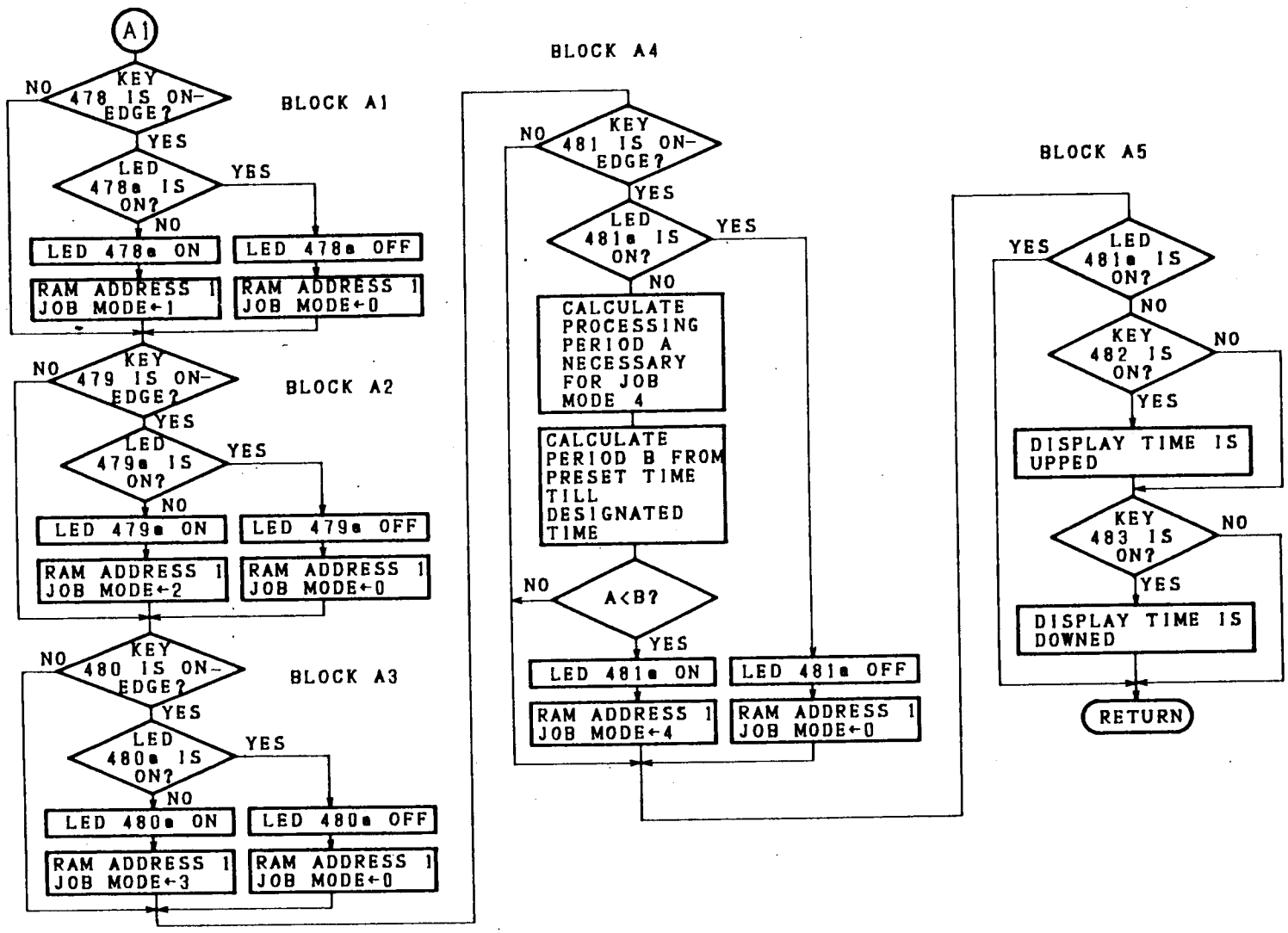

FIGS. 36 and 37 show a mode set routine of the second embodiment in Step A4 in FIG. 15 for setting the job mode aforementioned, in which processings for defining memory areas in the RAM map shown in FIG. 9 by data based on input operation and calculation are shown.

First, in Step A401 or Step A403, indicated numeral of the number of copies on the display 470 is incremented (or decremented) by ON-EDGE of the key 471 (or 472) (Step A402 or A404).

Then, by Steps A405 to A408, indicated numeral of the number of document sheets on the display 475 is similarly incremented (or decremented), and the CPU3 turns ON the display LED 476*a* by ON-EDGE of the set key 476 with the indicated numeral as the set value (Steps A409, A410).

When the number of copies and document sheets has been set, the CPU3 calls the mode memory routine to be described later (Step A411). Then, the job is selected and set by Blocks A1 to A4 shown in FIG. 37.

First, when the LED 478*a* (or LED 479*a*, 480*a*) is OFF by ON-EDGE of the key 478 (or 479, 480), the CPU3 turns it ON and sets the job mode of a RAM address 1 to "1" (or "2", "3"). Here, the case where a document is set in the DFU401 is shown as an example, and the RAM address N (=1) corresponds to the DFU number N (=1).

On the other hand, when the LED 478*a* (or LED 479*a*, 480*a*) is ON, the CPU3 turns it OFF and sets the job mode of the RAM address 1 to 0 or releases setting of the job. With reference to setting of the mode 4, it is performed in Block A4 in the following manner. First, the indicated time on the time display 484 is upped (or downed) by ON-EDGE of the key 482 (or 483) to set the copying completion time. Then, if the LED 481*a* is OFF by ON-EDGE of the key 481, the CPU3 calculates the processing period A necessary for the job, and then calculates the period B from the present time till the designated completion time to judge whether A<B. That is, the CPU3 judges whether or not processing of the job can be completed by the designated time, if it is possible, after turning ON the LED 481*a*, sets the job mode of the RAM address 1 to 4 and receives registration of the job.

While, when A<B, the CPU3 resets the completion time similarly by the time display 484. When releasing setting of the mode 4, the CPU3 turns OFF the LED 481*a* by ON-EDGE of the key 481 and sets the job mode of the RAM address 1 to "0".

In the two embodiments aforementioned, though the number of copies and document sheets is arranged to be set by the user when setting the documents in the DFU, the number of document sheets may be so arranged as to be detected automatically instead by the user himself.

Though the number of copies and document sheets and the copying completion time etc. are set by providing the operation panel on the DFU, it will be appreciated that it is not limited thereto, and such settings may be performed on the side of main body of the copying machine.

As described hereinabove, in the copying apparatus of the second embodiment, when multijob processing is performed by using a plurality of the DFUs, by setting the copying completion time for a document whose copied papers are not required immediately but must be obtained by the designated time, copying operation of a document in the other DFU whose copying completion time is not set is performed with superior priority, and when such copying operation is all completed and the empty time has occurred in the copying apparatus, the copying operation of the document in the DFU whose copying completion time has been set is started. Thereby, the waiting time can be shortened remarkably for the user who has a document requiring the copied paper immediately.

When a document is set newly in the other DFU after copying operation for a document whose copying completion time is set is started and the copying completion time is not set for this document, corresponding to the time relationship between the time required for copying operation of a document set unconditionally or newly and the copying completion time set for a document under the copying operation, copying operation of the DFU under the copying operation is interrupted and copying operation for the document newly set is started, thereafter the copying operation of the document which has been interrupted and whose completion time has been set is restarted. Furthermore, after such copying interruption or from the beginning, even when the empty time has not occurred in the copying apparatus, copying operation of the other DFU under the copying operation is interrupted, and copying operation of a document whose copying completion time has been set is started from the time counted backward from the processing time so as to complete copying by the set copying completion time.

Consequently, since the copying operation for a document whose copying completion time has been set is completed by the copying completion time, it is possible for the user to grasp the pick-up time for copied paper precisely, thus a going to the location fruitlessly where the copying apparatus is installed can be avoided.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying apparatus comprising:

a plurality of document feed means for feeding a plurality of documents one by one onto a document table, processing mode setting means for selectively setting an automatic copying processing mode for one of said document feed means, detecting means, disposed on said plurality of document feed means, for detecting the existence of documents, starting means for starting the operation of the document feed means which has been set to the automatic copying processing mode when idle time occurs, said idle time occurring when a document is not detected by said detecting means in any of the other document feed means in which the automatic copying processing mode is not set, thereby signifying the absence of documents in said other document feed means, and copying means for copying the documents fed to said document table.

2. A copying apparatus as set forth in claim 1, further comprising:

feed prohibiting means for prohibiting the operation of said other document feed means during the operation of said one document feed means.

3. A copying apparatus as set forth in claim 1, further comprising:

interrupting means for interrupting the operation of said one document feed means when a document is detected by at least one of said detecting means of said one of other document feed means.

4. A copying apparatus as set forth in claim 3, wherein said interrupting means interrupts the operation of said one document feeding means after a predetermined number of copies of the document on the document table has been completed:

5. A copying apparatus as set forth in claim 3, wherein said interrupting means interrupts the operation of said one document feeding means after one copy of the document on the document table has been completed.

6. A copying apparatus comprising:

a plurality of document feed means for feeding a plurality of documents onto a document table, copying quantity setting means for setting a number of documents at said document feed means and a number of copies therefor, copying time calculating means for calculating the time required for copying the documents in said document feed means on the basis of the content set by said copying quantity setting means, copying completion time setting means for setting the copying completion time of the documents in at least one of said plurality of document feed means, detecting means, disposed on said plurality of document feed means, for detecting the existence of documents, and starting means for starting a copying operation for the document feed means having documents in which said copying completion time has been set, when a document is not detected by said detecting means in an of the document feed means in which the copying completion time is not set, before the copying start time obtained by counting backward said copying time from the copying completion time set by said copying completion time setting means.

7. A copying apparatus as set forth in claim 6, wherein said starting means, when the copying operation of documents has not been started before the copy start time obtained by counting backward said copying time from said coping completion time, includes means for interrupting a copying operation of the other document feed means, and starting a copying operation of the document feed means having the document in which said copying completion time has been set.

8. A copying apparatus as set forth in claim 6, further comprising:

remaining time calculating means for calculating successively the time remaining until completion of the copying operation of the document feed means whose copying operation has been started by said copy start means, copying interrupting means for interrupting copying operation of documents in the document feed means under the copying operation, when a document is detected by one of said detecting means in one of the other document feed means after the copying operation by said starting means has been started, and the copying completion time for said document is not set, and copying time substituting means for substituting the remaining time calculated by said remaining time calculating means at copying interruption by said copying interrupting means for the copying time of said starting means.

9. A copying apparatus as set for the in claim 8, wherein said copying interrupting means, when a document is detected by said detecting means of the other document feed means after the copying operation by said starting means has been started and the copying completion time for said document is not set, includes means for interrupting a copying operation of the document in the document feed means during said copying operation, when the time obtained by adding the copying time of said document and the remaining time of the document feed means under the copying operation at detection of said document, to the detected time of said document is before the copying completion time of the document feed means during said copying operation.

10. A copying apparatus as set forth in claim 7 further comprising:

remaining time calculating means for calculating successively the remaining time until the completion of the copying operation of the document feed means whose copying operation is started by said starting means, copying interrupting means for interrupting copying operation of documents in the document feed means in operation, when a document is detected by one of said detecting means of one of the other document feed means after the copying operation by said starting means has been started, and the copying completion time is not set for said document, and copying time substituting means for substituting the remaining time calculated by said remaining time calculating means at copying interruption by said copying interrupting means for the copying time of said starting means.

11. A copying apparatus as set forth in claim 10, wherein said copying interrupting means, when a document is detected by one of said detecting means for one of the other document feed means after the copying operation by said starting means has been started and the copying completion time for said document is not set, interrupts copying operation of the document in the document feed means during said copying operation, when the time, obtained by adding the copying time of said document and the remaining time of the document feed means under the copying operation at detection of said document, to the detected time of said document, is before the copying completion time of the document feed means in operation.

12. A method for controlling a copying apparatus which comprises:

image forming means including a document table on which a document is placed for copying an image thereof; a plurality of document feed means, each having a document tray for holding a plurality of document sheets to be copied separately thereon, for sending the documents to said document table from the document trays; means for designating any one of said document feed means as having an inferior priority; and control means for associating said image forming means with said plurality of document feed means; said method comprising the steps of:

designating any one of document feed means as having an inferior priority, judging whether a document exists in a document feed means other than the designated document feed means, starting the operation of one of the document feed means in which a document exists other than the designated document feed means, judging the occurrence of idle time, said idle time occurring upon completion of operation of the document feed means other than the designated document feed means, and starting operation of the designated document feed means automatically at completion.

13. A copying apparatus comprising:

image forming means, having a document table onto which a document is placed, for copying an image of the document thereon, a plurality of document feed means, each having a document tray for holding separately thereon a plurality of document sheets to be copied, for sending the documents to said document table from the document trays, means for designating any one of said document feed means, and control means for prohibiting the operation of the designated document feed means when a document exists in a document feed means other than the designated document feed means, and for starting the operation of the designated document feed means automatically when idle time occurs, said idle time occurring when a document does not exist in any of the document feed means other than the designated document feed means, and a document exists in the designated document feed means.

14. A copying apparatus as set forth in claim 13, wherein said designating means includes means for designating the document feed means having an inferior priority.

15. A copying apparatus as set forth in claim 13, wherein said control means continues feeding the documents from the document tray till it is emptied, after operation of the designated document feed means has once been started.

16. A copying apparatus as set forth in claim 15, wherein said control means prohibits operation of the other document feed means during operation of the designated document feed means.

17. A copying apparatus as set forth in claim 13, wherein said control means interrupts operation of the designated document feed means, when documents are set in at least one of the other document feed means during operation of the designated document feed means.

18. A copying apparatus as set forth in claim 17, wherein said control means interrupts operation of the designated document feed means immediately, when documents are set in at least one of the other document feed means during operation of the designated document feed means.

19. A copying apparatus as set forth in claim 17, wherein said control means interrupts copying of the designated document feed means at a predetermined timing, when documents are set in at least one of the other document feed means during operation of the designated document feed means.

20. A copying apparatus as set forth in claim 13, further comprising:

a sorter having a plurality of bins for receiving copies;

copy quantity setting means for setting the number of document sheets held on said designated document feed means, and the number of copies to be made therefrom;

bin number calculating means for calculating the necessary number of bins of said sorter on the basis of the number of document sheets and copies set by said copy quantity setting means; and means, responsive to the calculation result of said bin number calculation means, for selecting predetermined bins of said sorter to which the copies from the document held on said designated document feed means are to be received.

21. A copying apparatus comprising:

image forming means including a document table on which a document is placed for copying an image thereof, a plurality of document feed means, each having a document tray for holding a plurality of document sheets to be copied separately thereon, for sending the documents to said document table from the document trays, condition setting means for setting separate copying conditions for each of the document feed means, means for designating any one of said document feed means, input means for inputting a copying completion time for documents held in the designated document feed means, calculating means, operable during the operation of the designated document feed means, for calculating an actual completion time when the copying operation of the designated document feed means will be completed, and control means, responsive to setting documents on one of the document feed means other than the designated document feed means during the operation of the designated document feed means, for interrupting the operation of the designated document feed means and starting operation of the other document feed means on which documents have been set, when the calculated completion time is before the inputted copying completion time.

22. A copying apparatus as set forth in claim 21, wherein said condition setting means sets the number of documents sheets and copies for respective documents, and said calculating means calculates said actual completion time on the basis of the number of documents and copies for the respective documents.

23. A copying apparatus as set forth in claim 21, wherein said control means starts automatically the operation of the interrupted designated document feed means, after completion of the operation of the document feed means other than the designated document feed means on which a document is set.

24. A method for controlling a copying apparatus which comprises: image forming means including a document table on which a document is placed for copying an image thereof; a plurality of document feed means, each having a document tray for holding a plurality of document sheets to be copied separately thereon, for sending the documents to said document table from respective document trays; condition setting means for setting separate copying conditions for respective document feed means; means for designating any one of said document feed means; input means for inputting a copying completion time of documents held in the designated document feed means; calculating means for calculating the actual completion time when the operation of the designated document feed means will be completed; and control means for associating said image forming means with said plurality of document feed means; said method comprising the steps of:

determining when a document is set in a document feed means other than the designated document feed means during operation thereof, calculating the operation completion time of the designated document feed means when document are set in the document feed means other than the designated document feed means, interrupting operation of the designated document feed means and starting operation of the other document feed means in which documents are set if the calculated completion time is before the inputted copying completion time, and restarting operation of the designated document feed means which has been interrupted, after completion of the operation of the other document feed means.

25. A copying apparatus comprising:

image forming means having a document table on which a document is placed for copying an image thereof, a plurality of document feed means, each having a document tray for holding a plurality of document sheets to be copied separately thereon, for sending the documents to said document table from the document trays, condition setting means for setting separate copying conditions for respective document feed means, means for designating any one of said document feed means, input means for inputting a copying completion time for documents held in the designated document feed means, calculating means for calculating the processing period for the document feed means in which documents are set, and control means, responsive to setting documents on one of the document feed means other than the designated document feed means during the operation of the designated document feed means, for interrupting operation of the designated document feed means and starting the operation of said other document feed means when the operation of the designated document feed means can be completed before the desired completion time.

26. A copying apparatus as set forth in claim 25, wherein said condition setting means sets the number of documents and copies for respective documents, and said calculating means calculates said processing time on the basis of the number of documents and copies for respective documents.

27. A copying apparatus as set forth in claim 25, wherein said control means restarts automatically the operation of the designated document feed means which has been interrupted, after the completion of copying operation of the other document feed means in which a document is set.

28. A copying apparatus comprising:

image forming means having a document table on which a document is placed for copying an image thereof, a plurality of document feed means, each having a document tray for holding a plurality of document sheets to be copied separately thereon, for sending the documents to said document table from respective document trays, sorting means having a plurality of bins for sorting copies, means for designating any one of said document feed means, first control means for prohibiting operation of the designated document feed means, when documents exist in a document feed means other than the designated document feed means, and for starting operation of the designated document feed means automatically when idle time occurs, said idle time occurring when documents do not exist in any of the document feed means other than the designated document feed means, and documents exist in the designated document feed means, and second control means for sorting copies of a document fed from the designated document feed means, and copies of a document fed from a document feed means other than the designated document feed means, into different bins.

* * * * *